US006859633B2

(12) United States Patent
Handa et al.

(10) Patent No.: US 6,859,633 B2
(45) Date of Patent: Feb. 22, 2005

(54) INTEGRAL-TYPE PROCESS CARTRIDGE AND DEVELOPING-ASSEMBLY UNIT INCLUDING NON-MAGNETIC ONE-COMPONENT TONER

(75) Inventors: Satoshi Handa, Shizuoka (JP); Hiroaki Kawakami, Kanagawa (JP); Yuji Moriki, Shizuoka (JP); Kiyokazu Suzuki, Shizuoka (JP); Yasuhiro Hashimoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/340,685

(22) Filed: Jan. 13, 2003

(65) Prior Publication Data

US 2003/0175043 A1 Sep. 18, 2003

(30) Foreign Application Priority Data

Jan. 16, 2002 (JP) ..... 2002-008069

(51) Int. Cl.[7] ..... G03G 15/04; G03G 15/08

(52) U.S. Cl. ..... 399/119; 399/252; 399/254

(58) Field of Search ..... 399/111, 119, 399/222, 252, 254, 255, 256, 258, 262, 263, 284, 285; 430/105, 107.1, 108.1, 108.4, 109.1, 109.4, 110.1, 110.3, 110.4

(56) References Cited

U.S. PATENT DOCUMENTS 4,777,512 A * 10/1988 Takahashi et al. ..... 399/254 X
4,987,452 A * 1/1991 Nakagawa et al. ..... 399/254
5,077,583 A * 12/1991 Bhagat ..... 399/255
5,701,571 A 12/1997 Amamiya et al. ..... 399/343
5,826,132 A * 10/1998 Damji et al. ..... 399/119 X
6,051,350 A * 4/2000 Inaba et al. ..... 430/45
6,085,051 A * 7/2000 Miyasaka et al. ..... 399/119 X
6,287,739 B1 * 9/2001 Kawakami et al. ... 430/110.3 X
6,289,190 B1 9/2001 Amamiya et al. ..... 399/174
6,301,453 B1 * 10/2001 Tsutsumi ..... 399/285 X
6,316,157 B1 * 11/2001 Yoshikawa et al. ..... 430/108.3
6,349,182 B2 2/2002 Otsubo et al. ..... 399/12
6,440,630 B2 * 8/2002 Isobe et al. ..... 430/124
2001/0028816 A1 * 10/2001 Kakeshita et al. ..... 399/284 X

FOREIGN PATENT DOCUMENTS

JP 2001-42625 2/2001

* cited by examiner

*Primary Examiner*—Sandra L. Brase
(74) *Attorney, Agent, or Firm*—Fitzpatrick, Cella, Harper & Scinto

(57) ABSTRACT

In a process cartridge having a latent-image-bearing member and a developing device having a developer-holding part and a developing member, at a vertical section which bisects in the process cartridge the surface of the latent-image-bearing member with which surface the developing member is brought into pressure contact, a developer agitation and transport member has at least two rotary agitation and transport members having rotating shafts falling at right angles with the vertical section. Where, at the vertical section, the area of the developer-holding part is represented by S1 and the area of the part corresponding to the movable region of the rotary agitation and transport member is represented by S2, the ratio of S2 to S1, S2/S1, is from 0.8 to 0.99; and the ratio of a long side Sa to a short side Sb, Sa/Sb, of a circumparallelogram having a minimum area in respect to the area S1 in the vertical section is from 1.5 to 3.0. The non-magnetic one-component developer contains at least a binder resin and a colorant and has a fluidity index of from 50 to 90 and a floodability index of from 45 to 96.

31 Claims, 7 Drawing Sheets

INTEGRAL-TYPE PROCESS CARTRIDGE AND DEVELOPING-ASSEMBLY UNIT INCLUDING NON-MAGNETIC ONE-COMPONENT TONER

BACKGROUND OF THE INVENTION

1. Field of the Invention

This invention relates to a process cartridge and a developing-assembly unit which are used for electrophotographic image-forming apparatus, such as copying machines, printers and facsimile machines of any of full-color, monochrome and monochromatic color uses, having a mechanism in which a developer image(s) is/are formed on an electrostatic latent image bearing member and thereafter transferred onto a transfer material to form an image.

This invention also relates to a process cartridge and a developing-assembly unit which are used for full-color electrophotography to perform development by the use of non-magnetic one-component developers consisting of yellow, magenta, cyan and black developers.

2. Related Background Art

A number of methods are conventionally known as methods for electrophotography. In general, copies or prints are obtained by forming an electrostatic latent image on an image-bearing member (photosensitive member) by utilizing a photoconductive material and by various means, subsequently developing the latent image by the use of a developer to form a developer image as a visible image, transferring the developer image to a transfer material such as paper, and then fixing the developer image to the transfer material by the action of heat and pressure or the like.

In recent years, such electrophotographic apparatus have been made compact because of the need for personal use of the apparatus. Meanwhile, there is an increasing demand for color-image formation. In particular, full-color image-forming apparatus must make use of a plurality of developing assemblies to form an image. In order to make such a full-color apparatus, it is required to design each developing assembly in a small size.

As conventional process cartridges, process cartridges for electrophotography are proposed which have various forms, such as a form in which a developer-holding container and an electrostatic latent image bearing member are integrally set, a form in which a developer-holding container and an electrostatic latent image bearing member are individually prepared and these are individually mounted to the apparatus to put them into use, and a form in which a developer-holding container is divided so that only a developer part can be replaced at the time of replenishment.

In particular, in the process cartridge in which the developer-holding container and the electrostatic latent image bearing member are integrally set, a large volume of a developer must be filled in a container of limited capacity because of various restrictions that developers be provided in a large volume and made to have a long lifetime and that the apparatus be made compact. Hence, such a process cartridge has a tendency that its developer-holding container has a complicated shape.

Accordingly, in order to make the image-forming apparatus compact, the shape of a developing assembly used for image formation is restricted by the layout of the apparatus main body. Because of such a restriction, process cartridges have employed various shapes. For example, a developer container is so designed as to be deep so that the developer can be held therein, as much as possible, at a limited position, or the space of the part holding the developer is partitioned to provide a plurality of holding chambers.

For example, Japanese Patent Application Laid-open No. 2001-42625 discloses an image-forming apparatus and a developing assembly which employ the combination of a developing assembly with a magnetic developer; the former consisting of a fist holding chamber for holding a developer and a second holding chamber communicating with the first holding chamber.

Meanwhile, even in process cartridges having developer-holding chambers having such a complicated shape, the developer must properly be circulated as in usual developing assemblies so that the developing performance can be made uniform throughout the initial development stage, the middle development stage and the last development stage. Accordingly, many studies have been made in order to make the developer circulate properly. For example, it is required to control the circulation of developer appropriately by the shape, agitation movement, and so forth, of an agitation means.

In addition, developing assemblies are being made adaptable to color-image formation. In order for them to be adaptable to color-image formation, not only a monochrome developer cartridge, but also developing assemblies having other color developers must be provided.

It is also highly demanded to form color images at a high speed. Accordingly, in order to meet such a demand, an in-line type full-color machine 110 has been developed in which yellow, magenta, cyan and black, developing assemblies are disposed on a straight line. In order to dispose the developing assemblies in such a way and achieve miniaturization of the assemblies and also hold therein the developers in large volumes, the cartridges must be thin and ensure a capacity for holding the developers.

In process cartridges thus made thin and made to have a large capacity, agitation and transport means tend to have a complicated construction. Accordingly, they are each so constructed as to have a plurality of rotary agitation and transport means. Since a plurality of such rotary agitation and transport means for the developer are provided, faulty transfer due to insufficient agitation of the developer tends to occur, compared with the case of a simple developer-transport means. Many studies on such agitation means have been made in terms of processes and mechanisms, and many devices have been produced. Consequently, however, apparatus have tended to become expensive because of a rise in the developing-assembly cost and the main-body cost incidental to the agitation. Also, especially in a developing system making use of non-magnetic one-component contact development, the bulk density of a developer therefor differs greatly from that of a magnetic toner, and hence the developer tends to be insufficiently agitated especially in the event the developer contains air. For this reason, with regard to the agitation of developers having a low bulk density like those of a non-magnetic one-component type, a specific method has been provided with respect to the relationship between the developer-holding part and the developer-transport means. Thus, any optimum circulation means has not been elucidated.

Meanwhile, as the developer, since it is used in the process cartridge having the developer-holding chamber having such a complicated shape, it is required to be a material whose fluidity, adherence and agglomeration have been controlled and which may hardly cause faulty circulation. Due to the structural restriction on the developing assembly as stated above, the developer may preferably be one having optimum physical properties. It is considered preferable that the physical properties required here are practical physical properties which more closely reflect the phenomena occurring in an actual developing assembly than measured values obtained from experimental results. The state in which the developer is actually used in the developing assembly is a condition in which the developer itself contains air to a certain extent. Such a condition differs from any condition in which, e.g., the degree of agglomeration of a developer is usually measured in an ideal-model condition, and hence it is not related to how the developer behaves actually in the developing assembly. In particular, the non-magnetic one-component developer is more greatly influenced by the bulk density of the developer than any magnetic developer or two-component developer, and the condition in which the developer is kept standing still differs greatly from its condition immediately after agitation. Accordingly, it is required to grasp the real fluidity, adherence and agglomeration of the non-magnetic one-component developer in the developing assembly, and to control these appropriately.

With regard to the fluidity characteristics of powders, a description relating to the floodability index advocated by Carr et al. is found in "Measurement of Physical Properties of Powders" (Asakura Shoten, 1963). This is an index expressing the fluidity at the time a powder contains air, and is a characteristic value used by showing the adherence, agglomeration, fluidity and so forth in marks.

This floodability index is also applied in electrophotographic developers. For example, Japanese Patent Application Laid-open No. 4-145755 discloses a one-component developer having a floodability index of from 50 to 80 and a developing system using the same. It discloses an effect that the use of the developer having such a floodability index can make the developer well transportable by agitation in the interior of the developing assembly. However, the above publication does not mention any relationship between the above developer and the developer-holding chamber, and does not suggest how the developer behaves when the developing assembly has a complicated and deep shape.

From the viewpoint of economical advantages, too, it is preferable that the developer remaining in a process cartridge having finished its service life is in a smaller quantity, and, in the developer-holding chamber having a complicated shape as stated above, it is necessary to use the developer with improved efficiency. For that reason, too, a synergistic effect is required which is attributable to the combination of the shape of the developer-holding chamber, the developer agitation means and the developer.

SUMMARY OF THE INVENTION

The present invention was made in order to solve the above problems. Accordingly, an object of the present invention is to provide a process cartridge, and a developing-assembly unit, which can achieve good circulation of a developer in a developer container and a process cartridge which have a plurality of rotary agitation and transport means, and can prevent the developer from solidifying even in its long-running use over a long period of time, to form images having good image quality.

Another object of the present invention is to provide a process cartridge, and a developing-assembly unit, which can achieve appropriate agitation of a developer in a developer-holding chamber, in a developer container and a process cartridge which have a plurality of rotary agitation and transport means, and do not cause any in-machine contamination due to the scattering of the developer and the leakage of the developer during continuous image reproduction.

Still another object of the present invention is to provide a process cartridge, and a developing-assembly unit, which can promise superior charging stability and may cause fewer variations in charge characteristics during running, even in a system called two-stage agitation in which a fresh developer and a developer having deteriorated as a result of running are mixed.

The present inventors have made extensive studies in order to solve the above problems. As a result, they have discovered that a developer container having a specific construction, an agitation means provided in the container, and a developer having a fluidity index and a floodability index within specific ranges may be used in combination and this enables formation of stable images with less changes in image density during the running lifetime of the cartridge.

More specifically, the present invention provides an integral-type process cartridge having at least a latent-image-bearing member for holding thereon an electrostatic latent image and a developing means for rendering visible the electrostatic latent image held on the latent-image-bearing member, by means of a non-magnetic one-component developer to form a toner image;

the developing means having a developer-holding part which holds therein the developer, a developer agitation and transport member for agitating the developer held in the developer-holding part, a developing member for performing development in pressure contact with the latent-image-bearing member, and a control member for controlling the quantity of the developer on the developing member;

at a vertical section which bisects in the process cartridge the surface of the latent-image-bearing member with which surface the developing member is brought into pressure contact, the developer agitation and transport member having at least two rotary agitation and transport means having rotating shafts falling at right angles with respect to the vertical section;

where, at the vertical section, the area of the developer-holding part is represented by S1 and the area of the part corresponding to the movable region of the rotary agitation and transport means is represented by S2, the ratio of S2 to S1, S2/S1, being from 0.8 to 0.99; and the ratio of a long side Sa to a short side Sb, Sa/Sb, of a circumparallelogram having a minimum area with respect to the area S1 in the vertical section being from 1.5 to 3.0; and the non-magnetic one-component developer containing at least a binder resin and a colorant and having a fluidity index of from 50 to 90 and a floodability index of from 45 to 96.

The present invention also provides a developing-assembly unit having a non-magnetic one-component developer for developing an electrostatic latent image, a developer-holding part which holds therein the developer, a developer agitation and transport member for agitating the developer held in the developer-holding part, a developing member for carrying the developer held in the developer-holding part and transporting the developer to a developing zone where the electrostatic latent image is to be developed, and for performing development in pressure contact with the latent-image-bearing member, and a control member for controlling the quantity of the developer on the developing member;

at a vertical section which bisects in the developing-assembly unit the surface of the latent-image-bearing member with which surface the developing member is brought into pressure contact, the developer agitation and transport member having at least two rotary agitation and transport means having rotating shafts falling at right angles with respect to the vertical section;

where, at the vertical section, the area of the developer-holding part is represented by S1 and the area of the part corresponding to the movable region of the rotary agitation and transport means is represented by S2, the ratio of S2 to S1, S2/S1, being from 0.8 to 0.99; and the ratio of a long side Sa to a short side Sb, Sa/Sb, of a circumparallelogram having a minimum area with respect to the area S1 in the vertical section being from 1.5 to 3.0; and the non-magnetic one-component developer containing at least a binder resin and a colorant and having a fluidity index of from 50 to 90 and a floodability index of from 45 to 96.

DESCRIPTION OF THE PREFERRED EMBODIMENTS

Figure 1:
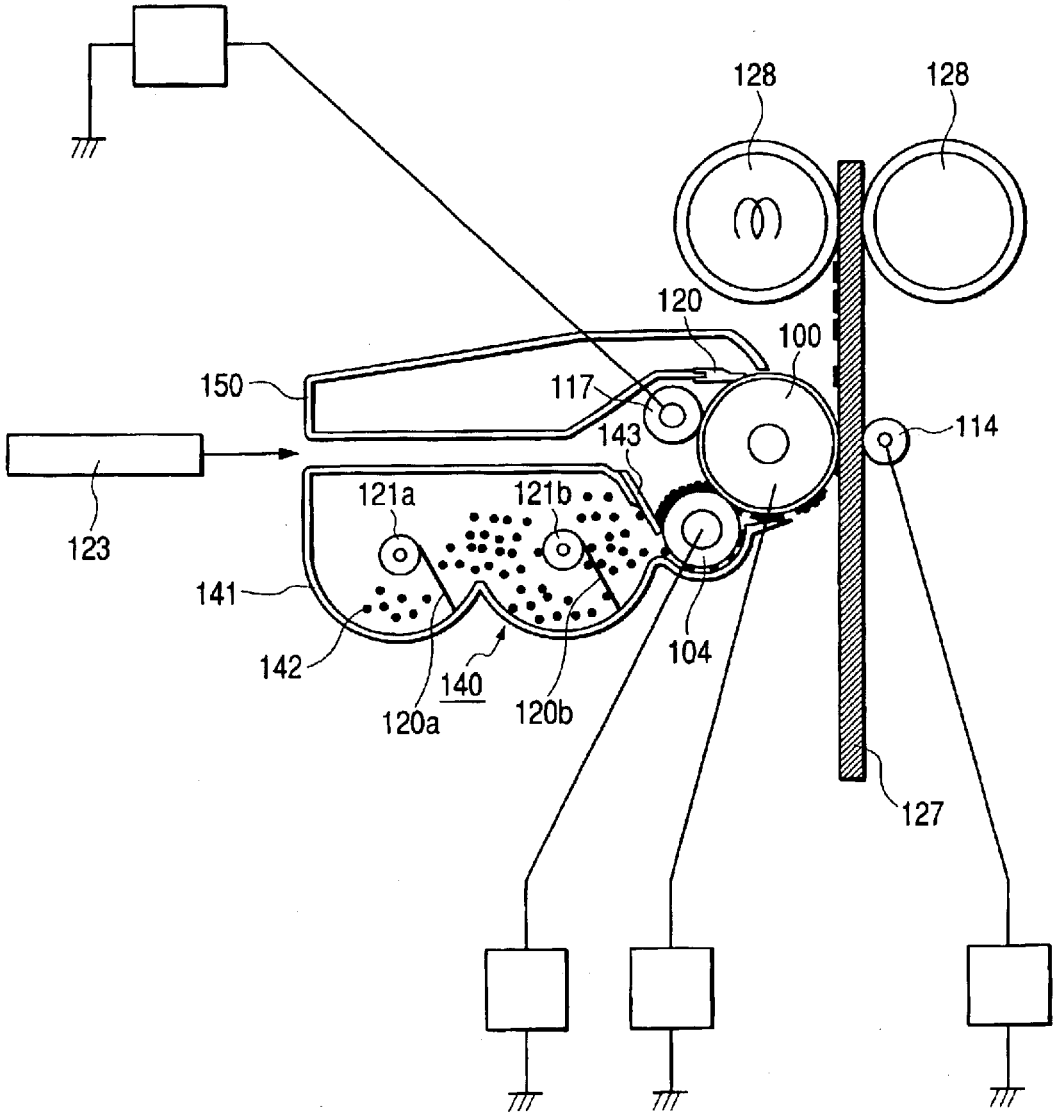
FIG. 1 is a schematic sectional view showing an example of a non-magnetic one-component image-forming apparatus in which the developer and process cartridge of the present invention are preferably used.

The present invention is described below in detail.

The process cartridge of the present invention is an integral-type process cartridge having at least a latent-image-bearing member for holding thereon an electrostatic latent image and a developing means for rendering visible the electrostatic latent image held on the latent-image-bearing member, by means of a non-magnetic one-component developer to form a toner image.

The developing means has a developer-holding part which holds therein the developer, a developer agitation and transport member for agitating the developer held in the developer-holding part, a developing member for performing development in pressure contact with the latent-image-bearing member, and a control member for controlling the quantity of the developer on the developing member.

At a vertical section which bisects in the process cartridge, the surface of the latent-image-bearing member with which surface the developing member is brought into pressure contact, the developer agitation and transport member has at least two rotary agitation and transport means having rotating shafts falling at right angles with respect to the vertical section.

Where, at the vertical section, the area of the developer-holding part is represented by S1 and the area of the part corresponding to the movable region of the rotary agitation and transport means is represented by S2, the ratio of S2 to S1, S2/S1, is from 0.8 to 0.99, and the ratio of a long side Sa to a short side Sb, Sa/Sb, of a circumparallelogram having a minimum area with respect to the area S1 in the vertical section is from 1.5 to 3.0.

The non-magnetic one-component developer contains at least a binder resin and a colorant and has a fluidity index of from 50 to 90 and a floodability index of from 45 to 96.

The developing-assembly unit of the present invention also has the same construction as the developing means in the process cartridge. Accordingly, in the following, the present invention is described with respect to the process cartridge.

By making the process cartridge have the above construction, the developer containing air can appropriately be agitated, and the developer can properly be circulated and fed to effect sufficient agitation of the developer, so that any faulty transfer of the developer can be prevented from occurring. This enables achievement of good circulation of the developer, and hence stable images with less changes in image density can be formed. Also, although the non-magnetic one-component developer changes greatly in developer-bulk density from when it is standing still to when it is agitated, setting the ratio of S2 to S1, S2/S1, to 0.8 to 0.99 makes it possible for the developer to undergo the changes in bulk density as little as possible, and hence the physical properties of the developer held in the developer container can be kept uniform as a whole.

Meanwhile, the non-magnetic one-component developer used in the process cartridge of the present invention contains at least a binder resin and a colorant, and is characterized by having a fluidity index of from 50 to 90 and a floodability index of from 45 to 96. Such a non-magnetic one-component developer contributes, in the process cartridge having the above construction, to the controlling of the changes in bulk density as stated above, and hence stable image formation can be performed.

The present invention is described in greater detail on its embodiments.

FIG. 1 is a schematic sectional view showing an example of an electrophotographic apparatus making use of the process cartridge of the present invention. This FIG. 1 is a schematic view of a vertical section which bisects the surface of the latent-image-bearing member with which surface the developing member is brought into pressure contact, in a process cartridge for a laser-beam printer utilizing an electrophotographic process of a non-magnetic one-component contact-developing system.

This process cartridge is an integral-type process cartridge having a latent-image-bearing member 100, a contact-type charging means 117 kept in contact with this latent-image-bearing member 100 to charge it electrostatically, a latent-image-forming means 123 for forming an electrostatic latent image on the latent-image-bearing member 100 charged by the charging means 117, a developing means 140 for rendering visible the electrostatic latent image held by means of a developer to form a toner image, and a removal means 120 for removing the residual developer remaining on the latent-image-bearing member 100 after the toner image has been transferred to a transfer material. The electrophotographic apparatus shown in FIG. 1 further has a transfer mechanism 114 for transferring to the transfer material 127 the toner image formed by the developing means 140, and a fixing means 128 for fixing to the transfer material 127 the toner image having been transferred onto the transfer material 127.

The developing means 140 has a developer container 141 functioning as the developer-holding part which holds therein a developer 142, two rotary agitation and transport means having agitation blades 120*a* and 120*b* and agitation shafts 121*a* and 121*b*, a developer-carrying member 104 (developing roller) as the developing member, kept in contact with the latent-image-bearing member 100, and a control member 143 for controlling the quantity of the developer on this developer-carrying member 104.

The developer 142 is filled into the developer container 141, and is fed to the developer-carrying member 104 by the two agitation and transport means 120*a* and 120*b*. The developer 142 on the developer-carrying member 104 is controlled by the control member 143 to form a developer layer and is simultaneously rubbed, so that it is coated in a thin layer on the developer-carrying member 104. The developer held on the developer-carrying member 104 renders visible the electrostatic latent image formed on the latent-image-bearing member 100 and is so set as to be in pressure contact therewith. The toner image formed by rendering the latent image visible is transferred onto the transfer material 127 by the transfer mechanism 114, and is thereafter heat-and-pressure fixed by the fixing means 128 to obtain a fixed image. The developer remaining on the latent-image-bearing member 100 after transfer is removed by the removal means 120, which is of a blade-contact-type device, so set as to come into pressure contact with the latent-image-bearing member 100, and is then collected into a waste-toner container 150. The latent-image-bearing member 100 from which the transfer residual developer has been removed is charged by the contact-type charging means 117. Thereafter, an electrostatic latent image is formed by the latent-image-forming means (exposure means) 123 and the development is successively performed.

Here, the process cartridge of the present invention is characterized in that, where, at the vertical section which bisects the surface of the latent-image-bearing member with which surface the developing member is brought into pressure contact, the area of the developer-holding part is represented by S1 and the area of the part corresponding to the movable region of the rotary agitation and transport means is represented by S2, and the ratio of S2 to S1, S2/S1, is from 0.8 to 0.99. This value may preferably be from 0.90 to 0.99, and more preferably from 0.95 to 0.99.

Figure 2:
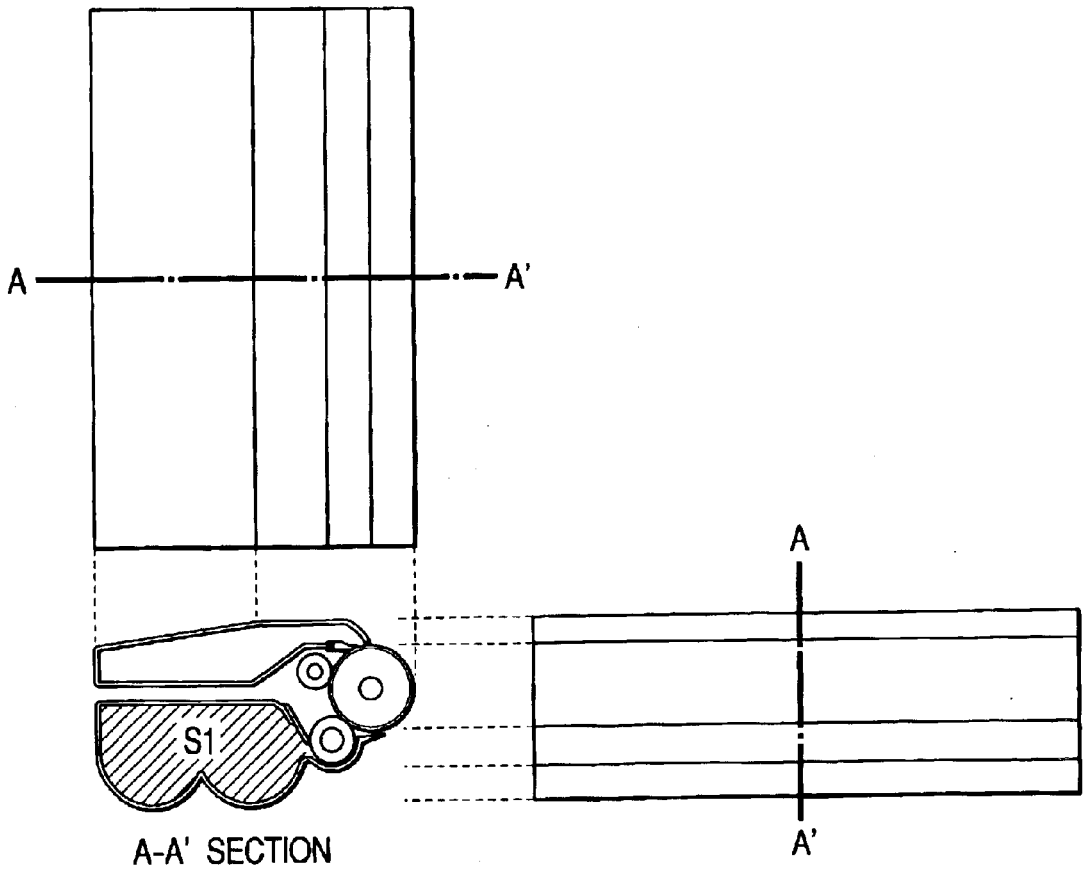
FIG. 2 is a diagrammatic view illustrating the cross section which prescribes the areas S1 and S2 in the process cartridge of the present invention.
Figure 3:
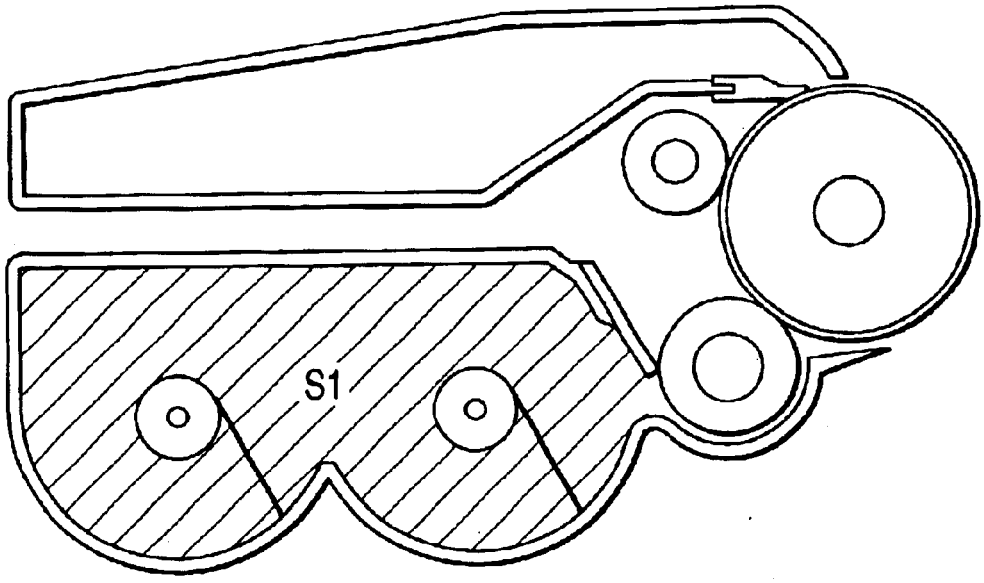
FIG. 3 illustrates the area S1 of the developer-holding part at the vertical section which bisects the surface of the latent-image-bearing member with which surface the developing member is brought into pressure contact.
Figure 4:
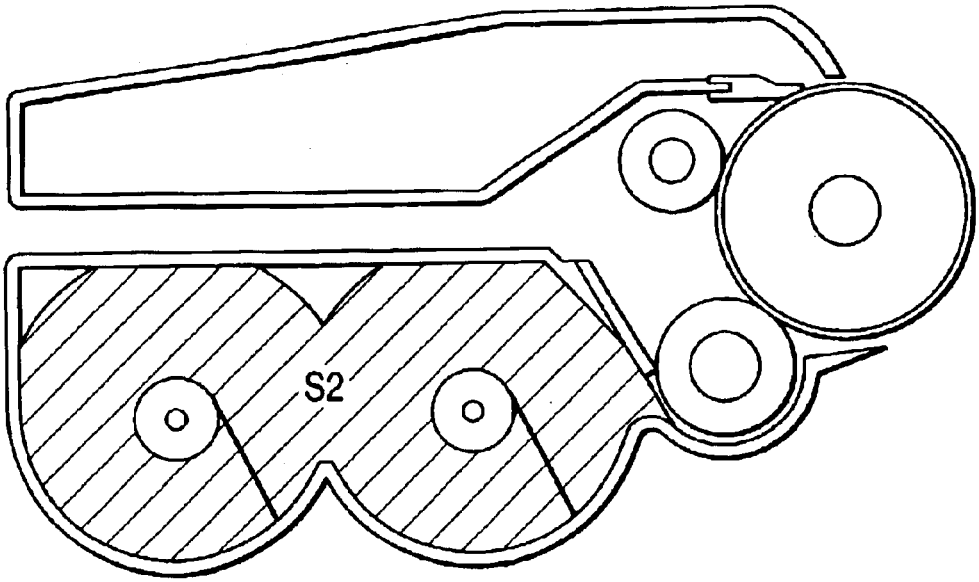
FIG. 4 illustrates the area S2 of the developer-holding part at the vertical section which bisects the surface of the latent-image-bearing member with which surface the developing member is brought into pressure contact.

FIGS. 2 to 4 are diagrammatic views illustrating the cross section which prescribes the areas S1 and S2 in the process cartridge shown in FIG. 1. The cross section which prescribes the areas S1 and S2 is a vertical section which bisects, along a cut surface as shown by a line A–A' in FIG. 2, the surface of the latent-image-bearing member 100 with which surface the developer-carrying member 104 is brought into pressure contact. More specifically, in FIG. 1, it is a cartridge cross section appearing when the process cartridge is so cut as to bisect the cartridge at its middle in its lengthwise direction. In the case of a process cartridge in which the shafts of the developer-carrying member 104 and latent-image-bearing member 100 are so disposed as to be parallel with each other, it follows that the above vertical section falls at right angles with these shafts. At this cross section, the cross section of the latent-image-bearing member 100 or developer-carrying member 104 comes closest to a true circle, and also the sectional area becomes a minimum.

The area S1 of the developer-holding part in the present invention represents the sectional area of the developer-container part at the above vertical section. As shown by a shaded portion in FIG. 3, this area S1 is the area of the developer-container part at which the part on the side of the developing member (developer-carrying member 104) is bordered on the part formed by the developer-carrying member 104 and the control member 143. Also, the area S2 of the part corresponding to the movable region of the rotary agitation and transport means is the sectional area of the part corresponding to the movable region of the developer agitation and transport means. As the definition therefor, as shown by a shaded portion in FIG. 4, it can be found by totalling the areas of figures formed by geometric loci along which the agitation and transport means move circularly when the agitation and transport means are moved by one period. Here, with respect of the part where the geometric loci overlap along which a plurality of agitation and transport means move circularly, the real area for only one part is included. Also, where the geometric loci deform for any reason in the container 141 when the agitation and transport means move circularly, the real area changed by such deformation is defined to be included.

As described above, in the present invention, the ratio of S2 to S1, S2/S1, is from 0.8 to 0.99. A value of S2/S1 which is less than 0.8 is undesirable because the effect of agitating the developer uniformly may become insufficient, to cause a problem that the developer stagnates because of faulty agitation, resulting in a decrease in image density because of local faulty agitation of the developer. Also, in order to make the ratio of S2 to S1 more than 0.99, excessively long stirring blades must be prepared. However, such long stirring blades are undesirable because the force of agitation tends to be non-uniformly applied and consequently they may rather cause faulty agitation.

Figure 5:
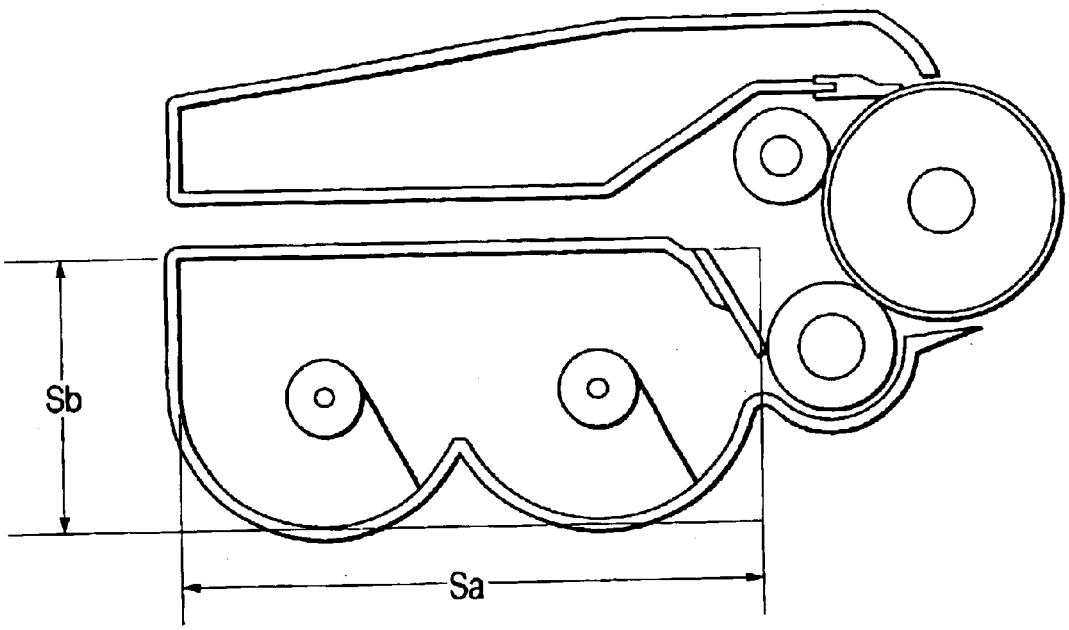
FIG. 5 illustrates the relationship between a long side Sa and a short side Sb of a circumparallelogram having a minimum area with respect to the area S1 in the process cartridge of the present invention.

FIG. 5 illustrates the long side Sa and short side Sb of a circumparallelogram having a minimum area with respect to the area S1. The process cartridge is characterized in that the ratio of Sa to Sb, Sa/Sb, is from 1.5 to 3.0. This value may preferably be from 1.5 to 2.8, and more preferably from 1.5 to 2.6.

There are no particular limitations on the plurality of rotary agitation and transport means used in the process cartridge of the present invention, as long as they can agitate the developer. Preferably usable are those which are so constructed as to have, as shown in FIG. 1, the agitation blades (120*a* and 120*b*) with which the developer is agitated and the agitation shafts (121*a* and 121*b*) around which these agitation blades are rotated. Also, in the present invention, the plurality of rotary agitation and transport means are so disposed that at least two means are present at the vertical section as shown in FIG. 1, i.e., the rotating shafts of the plurality of rotary agitation and transport means stand disposed in parallel and also these rotating shafts fall at right angles with the above vertical section.

There are also no particular limitations on the number of the plurality of rotary agitation and transport means as long as they are at least two, which may appropriately be selected in accordance with the relationship between the size of the developer-holding part (developer container) and the size of the rotary agitation and transport means and the agitation performance and transport performance for the developer. Also, where the number of the rotary agitation and transport means is three or more, there may be a rotary agitation and transport means having a rotating shaft concentric to other rotary agitation and transport means, as long as at least two rotary agitation and transport means are disposed at the above vertical section.

These at least two rotary agitation and transport means may also preferably be rotated in synchronization without any mutual interference.

As materials constituting the agitation blades of the rotary agitation and transport means, those having an appropriate elasticity and creep resistance may be used. For example, polyurethane rubber sheets or rubberized fabrics may be used. Particularly preferred are polyester (PET) films.

The agitation blades may each preferably have a thickness of from about 50 $\mu$m to 500 mm, and more preferably from about 150 $\mu$m to 300 $\mu$m. If they have a thickness of less than about 50 $\mu$m, the agitation blades may have a low elasticity to have a low developer-transport power. If they have a thickness of more than about 500 $\mu$m, the agitation blades may have so high an elasticity as to require a large rotational torque when the agitation blades are rotated, rubbing the inner walls of the container. Incidentally, in the examples given later, the agitation blades are each 200 $\mu$m in thickness.

As materials for the agitation shafts, taking account of the slidability and creep resistance at the part of bearings on both ends of the shafts, polyacetal (POM) is most preferred. Also, as methods for producing them, injection molding may preferably be used in view of the readiness of production.

The fixing of the agitation blades to the agitation shafts may be done by bonding or physical fitting. For example, a fixing method used in examples is a method in which caulking bosses are inserted into caulking holes and both are joined by ultrasonic caulking to make them integral.

As the shape of the agitation blades, it is desirable for each blade to be so formed as to have a length of a tangent along which the blade rubs the inner wall of the developer container. Also, the agitation blades may preferably be made to have notches or the like appropriately so as to fit with any unevenness of the inner walls of the developer container.

As the charging means usable in the process cartridge of the present invention, preferred is a means employing a method of performing charging by bringing a charging member into contact with the latent-image-bearing member. The preferred charging member is a charging roller constituted basically of a mandrel at the center and a conductive elastic layer that forms the periphery of the former.

As materials for the conductive elastic layer, conductive rubbers are preferred, and a releasing film may be provided on its surface. As the releasing film, a film of a nylon resin, PVDF (polyvinylidene fluoride), PVDC (polyvinylidene chloride) or the like may be used.

As the developer-carrying member, what is called an elastic roller, having an elastic layer at the surface, may preferably be used. As material hardness of the elastic layer used, one having a JIS-A hardness of from 20 degrees to 65 degrees may preferably be used.

As electrical resistance of the developer-carrying member, it may preferably have a volume resistivity of approximately from $10^2$ Ω·cm to $10^9$ Ω·cm. If it has a volume resistivity lower than $10^2$ Ω·cm, there is a possibility that excess electric current flows when, e.g., the surface of the latent-image-bearing member has pinholes or the like. On the other hand, if it has a volume resistivity higher than $10^9$ Ω·cm, the developer tends to be excessively charged by triboelectric charging to tend to cause a decrease in image density.

The developer on the developer-carrying member may preferably have a coat weight of from 0.1 mg/cm$^2$ to 1.5 mg/cm$^2$. If it has a coat weight smaller than 0.1 mg/cm$^2$, a sufficient image density may be achieved with difficulty. If it has a coat weight larger than 1.5 mg/cm$^2$, it may be difficult to triloelectrically charge all developer particles uniformly, to cause a great amount of fog. It may more preferably have a coat weight of from 0.2 mg/cm$^2$ to 0.9 mg/cm$^2$.

The coat weight of the developer on the developer-carrying member is controlled by the control member (developer control blade) 143. This developer-control blade 143 is kept in contact with the developer-carrying member 104 via the formed developer layer. Here, the pressure of contact of the developer-control blade with the developer-carrying member may preferably range from 5 g/cm to 50 g/cm. If its contact pressure is less than 5 g/cm, it may be difficult not only to control the developer-coat weight, but also to perform uniform triboelectric charging to cause a great amount of fog. On the other hand, if the contact pressure is more than 50 g/cm, the developer particles may undergo an excess load, and hence the particles may deform or the developer tends to melt-adhere to the developer-control blade or the developer-carrying member undesirably.

As a member which controls the developer-coat weight, an elastic blade for coating the developer in pressure contact, besides a metal blade or a roller, may be used.

For the control member having an elasticity, such as the elastic blade, it is preferable to select a material of a triboelectric series suited for charging the developer to the desired polarity. Usable are rubber elastic materials, such as silicone rubber, urethane rubber and NBR (nitrile-butadiene rubber), synthetic resin elastic materials such as polyethylene terephthalate, and metal elastic materials, such as stainless steel, copper, and phosphor bronze. Composites of any of these may also be used.

Where the elastic control member and the developer-carrying member are required to have durability, resin or rubber may be laminated to, or coated on, the metal elastic materials so as to touch the part coming into contact with the sleeve.

As a surface profile of the developer-carrying member, it is preferable to control its surface roughness in order to achieve both a high image quality and high durability. The developer-carrying member may have a surface roughness which is so set that, e.g., Ra ($\mu$m) of "JIS B-0601" comes to from 0.2 to 3.0. This enables achievement of both high image quality and high durability. If the developer-carrying member has a surface roughness Ra of more than 3.0, not only may it be difficult to control the developer layer to be a thin layer on the developer-carrying member, but also its charging performance for the developer can not be improved, thereby making it not expectable to improve image quality. By setting the surface roughness Ra of the developer-carrying member to be 3.0 or less, the transport ability of the developer on the surface of the developer-carrying member can be controlled, and the developer layer on the developer-carrying member can be made to be a thin-layer and also the number of times of the contact between the developer-carrying member and the developer can be made large. Hence, the charging performance for the developer can also be improved and the image quality is cooperatively improved. On the other hand, if the surface roughness Ra is set smaller than 0.2, it may be difficult to control the developer-coat weight.

In the present invention, the surface roughness Ra of the developer-carrying member corresponds to centerline average roughness measured with a surface-roughness measuring device (SURFCOADER SE-30H, trade name; manufactured by Kosaka Laboratory Ltd.) according to JIS surface roughness "JIS B-0601". Stated specifically, a portion of 2.5 mm is drawn out of the roughness curve, setting a measurement length a in the direction of its centerline. Where the centerline of this drawn-out portion is represented by the X axis, the direction of lengthwise magnification is represented by the Y axis, and the roughness is represented curve by y=f(x), the value is determined according to the following expression and indicated in micrometers ($\mu$m) is the surface roughness Ra.

$$Ra = (1/a)\int_0^a |F(x)|\,dx$$

In the present invention, the developer-carrying member may be rotated in the same direction as the rotation of the latent-image-bearing member, or may be rotated in the opposite direction. In the case when it is rotated in the same direction, the peripheral speed of the developer-carrying member may preferably be set 1.05 to 3.0 times the peripheral speed of the latent-image-bearing member.

An organic or inorganic substance may be added to the elastic control member for controlling the developer-coat weight. Such organic or inorganic substance may be added by melt-mixing, or may be added by dispersion. For example, any of metal oxides, metal powders, ceramics, carbon allotropes, whiskers, inorganic fibers, dyes, pigments and surface-active agents may be added so that the charging performance for the developer can be controlled. Especially where the control member is formed of a molded product of rubber or resin, a fine metal oxide powder, such as silica, alumina, titania, tin oxide, zirconium oxide or zinc oxide, carbon black, or a charge-control agent commonly used in developers, may preferably be incorporated therein.

Not illustrated in the drawings attached to the present specification, a coating member may also be provided between the developer-agitation member and the developer-carrying member. This is preferable in order to achieve the objects of the present invention. As the coating member, any known foams or brush-shaped or roller-shaped members may be used.

Such a coating member is commonly one intended to have the effect of feeding the developer onto the developer-carrying member and strip an old developer from the surface of the developer-carrying member. In order to obtain such an effect, it is common to control surface roughness when the coating member is a roller, and to control the extent of foaming when it is a foam. It is also common to control the degree of contact (elastic deformation level) between the developer-carrying member and the coating member or to control their relative speed. It is also preferable to provide a potential difference between the developer-carrying member and the coating member for the purpose of electrostatic transfer of the developer.

Figure 10:
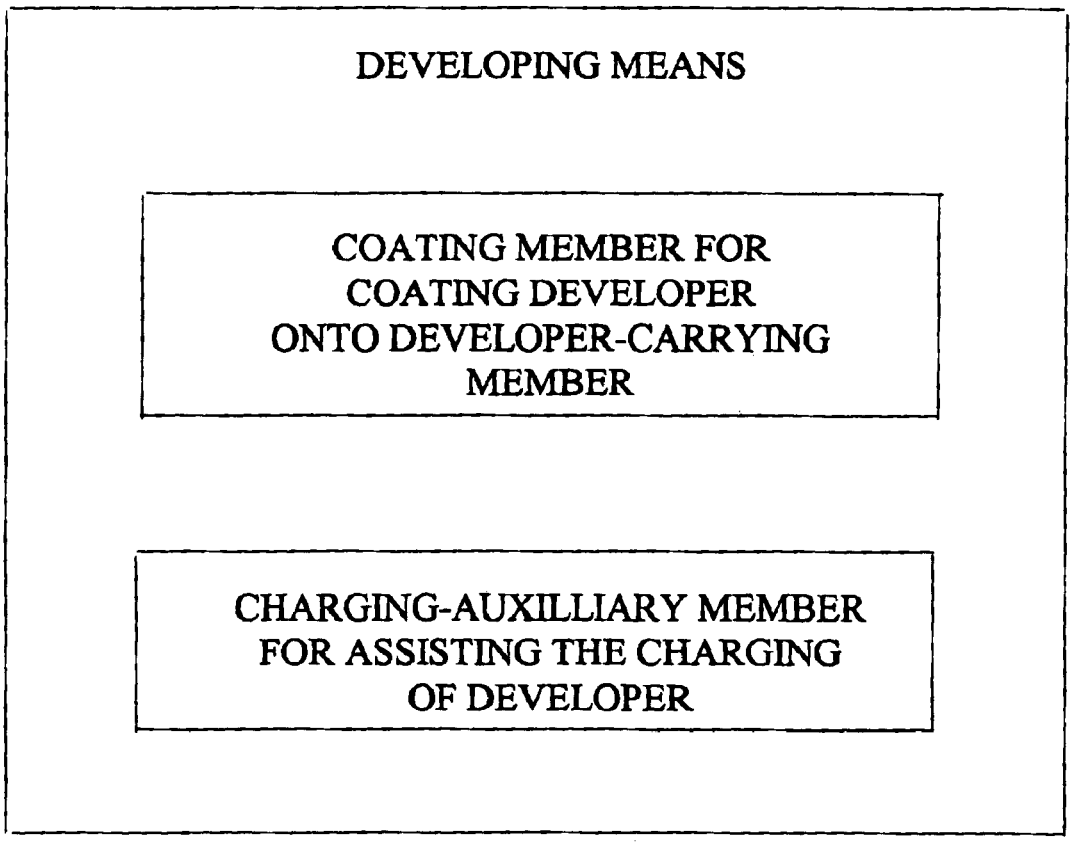
FIG. 10 is a schematic block diagram showing a coating member and an auxiliary charging member of the present invention.

It is also preferable to provide a charging auxiliary member which assists the charging of the developer in contact with the developer coated on the coating member under control of its coat weight, as shown in FIG. 10.

The auxiliary charging member is herein a member which is so provided that a contact member (not shown) comes into pressure contact with the surface of the developer-carrying member between the point of pressure contact of the control member 143 with the developer-carrying member 104 and the point of contact between the developer-carrying member 104 and the latent-image-bearing member 100 on the developer-carrying member 104 shown in FIG. 1 so that the developer on the developer-carrying member is charged by triboelectric charging or by the application of a bias to perform auxiliary charging.

As the auxiliary charging member, any known member may be used. Preferably, a conductive metallic blade or a conductive roller-shaped member may be used. Where triboelectric auxiliary charging is performed by the triboelectric charging, materials for known control members may be used. Also, where the conductive roller member is used, any known conductive roller members like those used in the developer-carrying member and the charging member may be used.

A direct-current electric field and/or an alternating-current electric field may further be applied to the control member. This also enables more improvement in uniform thin-layer coating performance and uniform charging performance by virtue of a loosening action on the developer, so that a sufficient image density can be achieved and images with good quality can be obtained.

As a mechanism for removing the residual developer, usable in the process cartridge of the present invention, the developer may preferably be removed by a removal means which is so provided as to come into pressure contact with the latent-image-bearing member. As the removal means, any known means may be used. Preferred is a rubbery elastic blade, and particularly preferred is a urethane-type elastic blade.

The non-magnetic one-component developer used in the above process cartridge of the present invention is described below. The non-magnetic one-component developer used in the present invention (hereinafter often simply "developer") contains at least a binder resin and a colorant, and is characterized by having a fluidity index of from 50 to 90 and a floodability index of from 45 to 96. It may preferably have a fluidity index of from 60 to 80, and more preferably from 65 to 80, and may preferably have a floodability index of from 70 to 90, and more preferably from 81 to 90.

As stated previously, non-magnetic one-component developers change greatly in developer-bulk density from when kept standing still to when agitated. In particular, developers adapted for high-quality image formation in recent years have a narrow particle-size distribution from the viewpoint of high transfer performance, high developing performance and high running performance, and are made to have so small a diameter that their central particle diameter is less than 10 $\mu$m. With respect to particle shape, too, particles close to spheres have beome prevalent. Developers controlled to have such a shape in non-magnetic one-component type developers tend very greatly to undergo a shrinkage in volume of developer (i.e., come to have a high bulk density) especially when kept standing still, and the changes in bulk density of developer between the case when they are standing still and the case when they are agitated are great.

Accordingly, the above developer in the present invention is used in combination with the above process cartridge of the present invention. This can keep small the changes in developer-bulk density when kept standing still and when agitated, having hitherto been questioned, and can maintain the agitation performance for the developer inside the developer container. Hence, the developer can well be transported and circulated.

Where a non-magnetic one-component developer not fulfilling the conditions of the present invention, having a small particle diameter and having a closely spherical shape is used in the process cartridge described above, the torque applied to the agitation shafts tends to rise abnormally, especially when the developer begins to be agitated in the state in which the developer has a high bulk density after it has been kept standing still. This may cause trouble in the main-body drive system, undesirably. Any further reinforcement of the drive system in order to avoid such trouble in the main-body drive system is undesirable because it leads to an increase in main-body cost. As a result of extensive studies especially on the characteristics of developers, we have discovered that developers with a Carr's fluidity index of less then 50 or with a Carr's floodability index of less than 45 tend to cause the above changes in bulk density.

It has also been revealed that the developers having such a fluidity index and a floodability index are undesirable because they not only cause a rise in torque of the agitation shafts when agitated after they have been kept standing still, but also, when the developer is agitated, they cause problems, such as developer stagnation and packing, which are due to partial faulty agitation and cause a decrease in image density, which is due to partial faulty transport of the developer.

In addition, such developers can not stably be controlled by the control member, and may cause a lowering of charge quantity during a running test to tend to cause image fog on white background areas of images, a decrease in development density, leakage (dropping) of developer and scattering of developer inside the main body. In particular, the leakage (dropping) of developer is undesirable because it appears on images in the form of spots of about 3 mm in size, and hence it produces a very bad impression. The scattering of developer inside the main body is also undesirable because, especially at the time of full-color development using yellow, magenta, cyan and black developers, it causes color-mix contamination on other process cartridges, changing the color hue.

On the other hand, non-magnetic one-component developers having a Carr's fluidity index of more than 90 or a Carr's floodability index of more than 96 are meant to be developers which are very free-flowing and have a high fluidity. Such developers tend to be transported with difficulty in the process cartridge of the present invention which is a process cartridge having such a different aspect ratio that may provide the Sa/Sb ratio of 3.0. Thus, although the developer is sufficiently left in the developing assembly, it can not be fed to the developer-carrying member, so that images are formed that are blurred, as if the developer has run short. In such a condition, development is impossible, and is consequently uneconomical. Moreover, such developers are controlled in excess by the control member, and hence the developer participating in development under excess control may become short to tend to cause a decrease in image density. Also, since the developer-coat weight on the developer-carrying member decreases, the pressure between the control member and the developer-carrying member becomes partially high, and the developer comes to tend to cling to the control member, so that development lines tend to appear, undesirably.

A developer having such a too high fluidity also tends to leak from sealed portions of the process cartridge. In particular, in a process cartridge which performs charging in contact with the latent-image-bearing member, any contamination due to leakage of such a developer having not been charged is so fatal for the charging member as to be unable to expel it by potential control. As a result, the latent-image-bearing member falls into faulty charging, where the part that experiences faulty charging comes to have the potential of an electrostatic latent image, so that an image may be printed in spite of white background areas, bringing about a great problem.

Thus, in the above combination of the process cartridge with the developer, the employment of the combination of the present invention can provide a very great effect.

A method of measuring the Carr's fluidity index and the Carr's floodability index in the developer used in the present invention is described below.

The Carr's fluidity index and the Carr's floodability index are measured with POWDER TESTER PT-R (trade name; manufactured by Hosokawa Micron Corporation) according to the method described in "Revised and Enlarged, Diagrams of Powder Physical Properties (edited by Powder Technology Society and Japan Powder Industrial Technology Association)", pp.151–155. Its specific procedure is as follows:

Measurement of Carr's Fluidity Index

Measurement is made on the following four items, and respective indices are calculated on the basis of the conversion table shown in Table 1. Their total value is regarded as the fluidity index.

A) Angle of repose.

B) Degree of compression.

C) Spatula angle.

D) Degree of agglomeration.

TABLE 1

| Angle of repose | | Degree of compression | | Spatula angle | | Degree of Agglomeration | |
|---|---|---|---|---|---|---|---|
| Deg. | Index | % | Index | Deg. | Index | % | Index |
| <25 | 25 | <5 | 25 | <25 | 25 | | |
| 26 to 29 | 24 | 6 to 9 | 23 | 26 to 30 | 24 | | |
| 30 | 22.5 | 10 | 22.5 | 31 | 22.5 | | |
| 31 | 22 | 11 | 22 | 32 | 22 | | |
| 32 to 34 | 21 | 12 to 14 | 21 | 33 to 37 | 21 | | |
| 35 | 20 | 15 | 20 | 38 | 20 | | |
| 36 | 19.5 | 16 | 19.5 | 39 | 19.5 | | |
| 37 to 39 | 18 | 17 to 19 | 18 | 40 to 44 | 18 | | |
| 40 | 17.5 | 20 | 17.5 | 45 | 17.5 | | |
| 41 | 17 | 21 | 17 | 46 | 17 | | |
| 42 to 44 | 16 | 22 to 24 | 16 | 47 to 59 | 16 | <6 | 15 |
| 45 | 15 | 25 | 15 | 60 | 15 | | |
| 46 | 14.5 | 26 | 14.5 | 61 | 14.5 | 6 to 9 | 14.5 |
| 47 to 54 | 12 | 27 to 30 | 12 | 62 to 74 | 12 | 10 to 29 | 12 |
| 55 | 10 | 31 | 10 | 75 | 10 | 30 | 10 |
| 56 | 9.5 | 32 | 9.5 | 76 | 9.5 | 31 | 9.5 |
| 57 to 64 | 7 | 33 to 36 | 7 | 77 to 89 | 7 | 32 to 54 | 7 |
| 65 | 5 | 37 | 5 | 90 | 5 | 55 | 5 |
| 66 | 4.5 | 38 | 4.5 | 91 | 4.5 | 56 | 4.5 |

TABLE 1-continued

| Angle of repose | | Degree of compression | | Spatula angle | | Degree of Agglomeration | |
|---|---|---|---|---|---|---|---|
| Deg. | Index | % | Index | Deg. | Index | % | Index |
| 67 to 89 | 2 | 39 to 45 | 2 | 92 to 99 | 2 | 57 to 79 | 2 |
| 90 | 0 | >45 | 0 | >99 | 0 | >79 | 0 |

A) Measurement of Angle of Repose:

The developer is dropped on a round table of 8 cm in diameter through a funnel, and the angle of a conical heap formed is directly measured with a procractor. In measuring it, to feed the developer, a sieve with a mesh of 608 μm (24 meshes) is set on the funnel, and the developer is placed thereon and is fed to the funnel under the application of a vibration.

B) Measurement of Degree of Compression:

The degree of compression C is calculated according to the following equation.

$$C=[(\rho P-\rho A)/\rho P]\times 100$$

Here, the ρA is the bulk density. The developer is uniformly fed from above to a cylindrical container of 5.03 cm in diameter and 5.03 in height through a sieve with a mesh of 608 μm (24 meshes). Then, the developer is leveled at the top of the container and its weight is measured to determine the ρA.

The ρP is the tapping density. After the ρA has been measured, the container is fitted with a cylindrical cap, and a powder is put into it up to its top edge, followed by tapping 180 times at a tap height of 1.8 cm. After the tapping has been completed, the cap is taken off. Then, the powder is leveled at the top of the container, and its weight is measured. The density in this state is regarded as the ρP.

C) Measurement of Spatula Angle:

A 22 mm×120 mm spatula made of metal is horizontally set right above an up-and-down movable tray, and a powder having passed through a sieve with a mesh of 608 μm (24 meshes) is accumulated thereon. After it has sufficiently been accumulated, the tray is gently descended, where the angle of the side of the powder having remained accumulated on the spatula is denoted by (1). Next, a shock is once applied to an arm supporting the spatula, by dropping a weight thereon, and the angle measured again is denoted by (2). The average value of the angles (1) and (2) is regarded as the spatula angle.

D) Measurement of Degree of Agglomeration:

To make this measurement, sieves with three kinds of meshes are set one over another in the top, middle and bottom steps in the order of coarser meshes, and 2 g of a powder is put thereon. After vibration is applied thereto at an oscillation of 1 mm, the degree of agglomeration is calculated from residues on the sieves. The sieves used are determined by the values of bulk density. Where the bulk density is less than 0.4 g/cm$^3$, sieves with a mesh of 355 μm (40 meshes), 263 μm (60 meshes) and 154 μm (100 meshes) are used. Where the bulk density is from 0.4 g/cm$^3$ or more to less than 0.9 g/cm$^3$, sieves with a mesh of 263 μm (60 meshes), 154 μm (100 meshes) and 77 μm (200 meshes) are used. Where the bulk density is 0.9 g/cm$^3$ or more, sieves with a mesh of 154 μm (100 meshes), 77 μm (200 meshes) and 43 μm (325 meshes) are used.

Here, the vibration time T (sec.) is determined according to the following equations.

$$T=20+\{(1.6-\rho W)/0.016)\}$$

$$\rho W=(\rho P-\rho A)\times(C/100)+\rho A$$

Residues w1, w2 and w3 on the top, middle and bottom steps, respectively, are measured, and the degree of agglomeration $C_0$ is found according to the following equation.

$$C_0=w1\times 100\times(1/2)+w2\times 100\times(1/2)\times(3/5)+w3\times 100\times(1/2)\times(1/5)$$

Carr's Floodability Index

Measurement is made on the following four items, and respective indices are calculated on the basis of the conversion table shown in Table 2. Their total value is regarded as the floodability index.

E) Fluidity.

F) Angle of rupture.

G) Difference angle.

H) Dispersibility.

TABLE 2

| Fluidity | | Angle of repture | | Difference angle | | Dispersibility | |
|---|---|---|---|---|---|---|---|
| (1) | Index | Deg. | Index | Deg. | Index | % | Index |
| >60 | 25 | 10 | 25 | >30 | 25 | >50 | 25 |
| 59 to 56 | 24 | 11 to 19 | 24 | 29 to 28 | 24 | 49 to 44 | 24 |
| 55 | 22.5 | 20 | 22.5 | 27 | 22.5 | 43 | 22.5 |
| 54 | 22 | 21 | 22 | 26 | 22 | 42 | 22 |
| 53 to 50 | 21 | 22 to 24 | 21 | 25 | 21 | 41 to 36 | 21 |
| 49 | 20 | 25 | 20 | 24 | 20 | 35 | 20 |
| 48 | 19.5 | 26 | 19.5 | 23 | 19.5 | 34 | 19.5 |
| 47 to 45 | 18 | 27 to 29 | 18 | 22 to 20 | 18 | 33 to 29 | 18 |
| 44 | 17.5 | 30 | 17.5 | 19 | 17.5 | 28 | 17.5 |
| 43 | 17 | 31 | 17 | 18 | 17 | 27 | 17 |
| 42 to 40 | 16 | 32 to 39 | 16 | 17 to 16 | 16 | 26 to 21 | 16 |
| 39 | 15 | 40 | 15 | 15 | 15 | 20 | 15 |
| 38 | 14.5 | 41 | 14.5 | 14 | 14.5 | 19 | 14.5 |
| 37 to 34 | 12 | 42 to 49 | 12 | 13 to 11 | 12 | 18 to 11 | 12 |
| 33 | 10 | 50 | 10 | 10 | 10 | 10 | 10 |
| 32 | 9.5 | 51 | 9.5 | 9 | 9.5 | 9 | 9.5 |
| 31 to 29 | 8 | 52 to 56 | 8 | 8 | 8 | 8 | 8 |
| <28 | 6.25 | 57 | 6.25 | 7 | 6.25 | 7 | 6.25 |
| 27 | 6 | 58 | 6 | 6 | 6 | 6 | 6 |
| 26 to 23 | 3 | 59 to 64 | 3 | 5 to 1 | 3 | 5 to 1 | 3 |
| <23 | 0 | >64 | 0 | 0 | 0 | 0 | 0 |

(I): Index According to Table 1

E) Fluidity:

As to the fluidity, the fluidity indices are used as they are.

F) Angle of Rupture:

After the angle of repose has been measured, a constant shock is applied by dropping a weight on a rectangular bat on which an injection angle-of-repose base is kept put, to rupture a heap. The angle of the slope after rupture is regarded as the angle of rupture.

G) Difference Angle:

The difference between the angle of repose and the angle of rupture is regarded as the difference angle.

H) Dispersibility.

Figure 6:
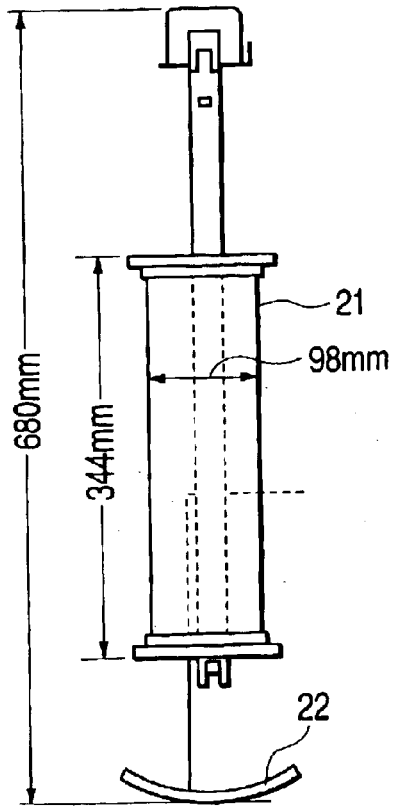
FIG. 6 is a schematic view of a dispersion-degree measuring device.

As shown in FIG. 6, 10 g of a powder is dropped in a mass from above through a glass cylinder 21 of 98 mm in inner diameter and 344 mm in length, and the weight w of the powder having accumulated on a watch glass 22 is measured, and the dispersibility is found according to the following equation.

$$\text{Dispersibility }(\%)=(10-w)\times 100/10$$

These developer characteristics are measured in an environment of a relative humidity of 50% and a temperature of 20° C.

As the particle shape of the developer used in the present invention, the developer may preferably have a circle-corresponding number-average particle diameter (D1) of from 2.0 to 10.0 μm in its number-based particle-diameter frequency distribution; and an average circularity of from 0.920 to 0.995 and a circularity standard deviation of less than 0.040 in its particle-diameter frequency distribution. Controlling the particle shape of the developer precisely to the above shape enables well-balanced improvement in fluidity, floodability and developing performance.

As the developer is made to have such a small particle diameter that the circle-corresponding number-average particle-diameter in its number-based particle-diameter frequency distribution is from 2.0 to 10.0 μm, high-quality image formation can be achieved. However, the fluidity and floodability of the developer stand in a relationship that they decrease as the particle diameter of the developer is made smaller. Accordingly, in the present invention, by controlling the degree of sphericity of the developer particles and making the circularity standard deviation less than 0.035, the fluidity and floodability are improved so that they can contribute to an improvement in developing performance conjointly with the achievement of small particle diameter in the developer. The developer may more preferably have a circle-corresponding number-average particle diameter of from 4.0 to 10.0 μm, and still more preferably from 6.0 to 8.0 μm, and may preferably have a circularity standard deviation of from 0.015 to 0.035.

When the developer is made to have an average circularity of from 0.920 to 0.995, preferably from 0.950 to 0.995, and more preferably from 0.970 to 0.995 in its circularity frequency distribution, the transfer performance of the developer having a small particle diameter can greatly be improved, which has ever been difficult to do, and also the developability for low-potential latent images can be generally improved. Such a developer is effective especially when minute spot latent images of a digital system are developed.

If the developer has an average circularity outside the above range, it not only may have a poor transfer performance, but also may have a low developing performance. Also, if it has an average circularity of more than 0.995, developer-particle surfaces may greatly deteriorate to cause problems with respect to running performance and so forth.

The influence on transfer performance and developing performance that is due to differences in average circularity of the developer as stated above may be remarkable especially when a full-color copying machine is used in which a plurality of toner images are developed and transferred. More specifically, when a full-color image is formed, the four color toner images may uniformly be transferred with difficulty, and also, when an intermediate transfer member is used, a problem tends to occur with respect to color uniformity and color balance, making it difficult to reproduce high-quality full-color images stably. However, the developer used in the present invention, in which the particle diameter and average circularity of the developer are controlled within the above ranges, can satisfy the transfer performance and the developing performance simultaneously in the full-color copying machine, and can form images with high image quality.

The circle-corresponding diameter, circularity, and frequency distribution of the developer in the present invention are used as a simple method for expressing the shape of developer particles quantitatively. In the present invention, they are measured with a flow type particle image analyzer FPIA-1000 (trade name; manufactured by Toa Iyou Denshi K.K.), and are calculated according to the following expressions.

$$\text{Circle-corresponding diameter} = (\text{particle projected area}/\pi)^{1/2} \times 2$$

$$\text{Circularity} = \frac{\text{Circumferential length of a circle with the same area as particle projected area}}{\text{Circumferential length of particle projected image}}$$

Here, the "particle projected area" is meant to be the area of a binary-coded developer particle image, and the "circumferential length of particle projected image" is defined to be the length of a contour line formed by connecting edge points of the developer-particle image.

The circularity referred to in the present invention is an index showing the degree of surface unevenness of developer particles. It is indicated as 1.00 when the developer particles are perfectly spherical. The more complicated the surface shape, the smaller the value its circularity.

In the present invention, the circle-corresponding number-average particle diameter, which means an average value of the number-based developer-particle frequency distribution of the developer, and particle-diameter standard deviation SDd are calculated from the following expressions where the particle diameter at a partition point i of particle size distribution (a central value) is represented by di, and the frequency by fi.

$$\text{Circle-corresponding number-average particle diameter } \bar{d}, = \sum_{i=1}^{n} (fi \times di) / \sum_{i=1}^{n} (fi)$$

$$\text{Particle diameter standard deviation SDd} = \left\{ \sum_{i=1}^{n} (\bar{d}, - di)^2 / \sum_{i=1}^{n-1} (fi) \right\}^{1/2}$$

The average circularity, which means an average value of the circularity frequency distribution, and the circularity distribution SDc are calculated from the following expression where the circularity at a partition point i of particle-size distribution (a central value) is represented by ci, and the frequency by $f_{ci}$.

$$\text{Average circularity } \bar{c} = \sum_{i=1}^{m} (ci \times fci) / \sum_{i=1}^{m} (fci)$$

$$\text{Circularity standard deviation SDc} = \left\{ \sum_{i=1}^{m} (\bar{c}, - ci)^2 / \sum_{i=1}^{m-1} (fci) \right\}^{1/2}$$

As a specific measuring method, 10 ml of ion-exchanged water from which solid matter impurities have previously been removed is put in a container, and as a dispersant a surface-active agent, preferably alkylbenzene sulfonate, is added thereto. Thereafter, 0.02 g of a measuring sample is further added thereto, followed by uniform dispersion. As a means for the dispersion, an ultrasonic dispersion machine Model UH-50 (manufactured by SMT Co.) to which a 5 mm diameter titanium alloy tip is attached as a vibrator is used, and dispersion treatment is made for 1 minute to 5 minutes to prepare a dispersion for measurement. Here, the dispersion is appropriately cooled so that its temperature does not exceed 40° C.

The developer-particle shape is measured using the above flow-type particle-image. Concentration of the dispersion is again so adjusted that the developer particles are in a concentration of from 3,000 to 10,000 particles/μl at the time of measurement, and 1,000 or more particles are measured. After measurement, the data obtained are used to determine the circle-corresponding diameter and the circularity frequency distribution of the developer, according to the above expressions.

The binder resin contained in the developer used in the present invention may be any of those used in the production of developers and there are no particular limitations. As examples of the binder resin used in the present invention, usable are polymers of polymerizable monomers shown below, or mixtures of polymers of the polymerizable monomers by themselves, or copolymer products of two or more of the polymerizable monomers. Stated more specifically, styrene-acrylic acid copolymers or styrene-methacrylic acid copolymers are preferred.

Styrene-type polymerizable monomers may include, e.g., styrene, and styrene derivatives such as o-methylstyrene, m-methylstyrene, p-methylstyrene, p-methoxystyrene, p-phenylstyrene, p-chlorostyrene, 3,4-dichlorostyrene, p-ethylstyrenee, 2,4-dimethylstyrene, p-n-butylstyrene, p-tert-butylstyrene, p-n-hexystyelene, p-n-octylstyrene, p-n-nonylstyrene, p-n-decylstyrene and p-n-dodecylstyrene.

Acrylate-type type polymerizable monomers may include, e.g., acrylic esters and derivatives thereof, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate. Methacrylate type polymerizable monomers may include, e.g., a-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate.

In order to adjust the fixing temperature of the developer, the binder resin used in the developer in the present invention may preferably contain a cross-linkable polymerizable monomer as exemplified below.

As the cross-linkable polymerizable monomer, a polymerizable monomer having at least two polymerizable double bonds may be used. As specific examples, it may include bifunctional cross-linking agents as exemplified by divinylbenzene and divinylnaphthalene, bis(4-acryloxypolyethoxyphenyl)propane, diacrylates such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate and polyethylene glycol #600 diacrylate, dipropylene glycol diacrylate, polypropylene glycol diacrylate, polyester type diacrylates (e.g., MANDA, trade name; available from Nippon Kayaku Co., Ltd.), and the above compounds whose acrylate moiety has been replaced with methacrylate.

Polyfunctional cross-linking agents may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; 2,2-bis(4-methacryloxypolyethoxyphenyl)propane, diallyl phthalate, triallyl cyanurate, triallyl isocyanurate and triallyl trimellitate.

Of these cross-linkable polymerizable monomers, those preferably usable are aromatic divinyl compounds (in particular, divinylbenzene) and diacrylate compounds linked with a chain containing an aromatic group and an ether linkage, any of which may be used in an amount of approximately from 0.01 to 5 parts by weight, and more preferably approximately from 0.03 to 3 parts by weight, based on 100 parts by weight of other polymerizable monomer components. In addition of any of these cross-linkable polymerizable monomers enables control of the melt index of the developer, and can make melt-adhesion to blade occur less in the non-magnetic one-component developing system. Also, the developer can be improved in storage stability and environmental stability.

To obtain the binder resin used in the present invention, it is preferable to use a polymerization initiator as exemplified below.

Stated specifically, it may include, as examples of peroxide type initiators, t-butyl peroxy-2-ethylhexanoate, cumin perpivalate, t-butyl peroxylaurate, benzoyl peroxide, lauroyl peroxide, octanoyl peroxide, di-t-butyl peroxide, t-butylcumyl peroxide, 1,1-bis(t-butylperoxy)-3,3,5-trimethylcyclohexane, n-butyl 4,4-bis(t-butylperoxy) varilate, dicumyl peroxide, and derivatives of these.

It may also include, as examples of azo type and diazo type initiators, 2,2'-azobisisobutyronitrile, 2,2'-azobis(2-methylbutyronitrile), 2,2'-azobis(2,4-dimethylvaleronitrile) and 2,2'-azobis(4-methoxy-2,4-dimethylvaleronitrile).

Any of these polymerization initiators may be used alone or in combination of two or more, and may be used in an amount of from 0.05 to 15 parts by weight, and more preferably from 0.5 to 10 parts by weight, based on 100 parts by weight of the polymerizable monomer.

Meanwhile, in the developer used in the present invention, the vinyl-type (styrene type or acrylate type) polymerizable monomer may preferably be in a residue of 200 ppm or less, more preferably 150 ppm or less, and still more preferably 50 ppm or less. If the monomer remaining in the developer (residual monomer) is in an amount of more than 500 ppm, a problem may arise with the charging performance and anti-blocking properties of the developer.

In the present invention, the residual monomer refers to an unreacted monomer remaining when the binder resin is produced or the developer is directly produced by polymerization as described later. It may also include a low-molecular-weight by-product coming from the unreacted monomer, as exemplified by benzaldehyde or benzoic acid produced from oxidation and decomposition of styrene.

As methods for making less residual monomer remain in the developer, known methods may be used. For example, the residual monomer may be held back by controlling the manner of adding the initiator or the reaction temperature when the binder resin is produced or the developer is directly produced by polymerization, or the residual monomer may be removed by carrying out distillation after polymerization.

As other methods, when the developer is produced by pulverization, the residual monomer may be removed by reducing the pressure when raw materials are heated and kneaded by means of a kneader or the like. When the developer is produced by polymerization, the residual monomer may be removed with a relatively good efficiency by utilizing a spray dryer or the like. Especially when the developer is produced by suspension polymerization, the residual monomer is removable also during the heating and drying of developer particles, where the developer particles are treated with stirring under heating and reduced pressure, using a conical mixing machine (dryer). In this case, though, in general, the treatment is limited to the removal of water content in the developer, stirring conditions and treatment time may be controlled, whereby not only the residual monomer can be removed but also the developer particles can simultaneously be treated to make them spherical, so that the particle shape of the developer can be made proper.

In order to control the residual monomer in the developer to be in the amount of 200 ppm or less and to make the developer have the desired particle shape, the developer particles may be treated by heating and stirring them under reduced pressure of 13.3 kPa (100 Torr), for at least 4 hours in a temperature range of from 35° C. or higher to a temperature not higher than the glass transition temperature (Tg) of the binder resin component. Conventionally, it has been difficult to remove residual monomers under such treatment conditions, or such treatment has caused agglomeration or coalescence of developer particles themselves. However, the state of dispersion and thermal properties of a wax component may be specified as described later. This makes it easy to remove the residual monomer from the interiors of developer particles, and also can make developer particles almost not turn coarse and can minimize any influence of the wax component, against the treatment for making the developer particles spherical. Thus, this method can be very effective.

In the present invention, as to methods of determining the residual monomer in the developer, usable are known methods including (i) a method making use of thermogravimetry (TG) which performs a measurement of weight loss at the time of heating, by means of a thermobalance, or (ii) a method making use of gas chromatography (GC). In particular, the method making use of GC is an especially effective method.

In the present invention, in the case when the residual monomer in the developer is determined by TG, it is found from a weight loss on heating which is observed when a sample is heated to 200° C. A specific example is shown below.

TG Measurement Conditions

Apparatus: TGA-7, PE7700 (manufactured by Perkin-Elmer Corporation.

Heating rate: 10° C./min.

Measurement environment: In an atmosphere of $N_2$.

A specific example of the instance where the residual monomer in the developer is determined by GC is shown below.

GC Measurement Conditions

Apparatus: GC-14A (manufactured by Shimadzu Corporation).

Column: Fused silica capillary column (manufactured by J & W Scientific Co;

size: 30 m×0.249 mm; liquid phase: DBWAX; layer thickness: 0.25 μm)

Sample: Using 2.55 mg of DMF as an internal reference, a solvent containing the internal reference is prepared by adding 100 ml of acetone. Next, 400 mg of the developer is dissolved in the solvent to make up a 10 ml solution. After treatment with an ultrasonic shaker for 30 minutes, the solution is left for 1 hour. Next, the solution is filtered with a 0.5 mm filter. The sample is injected in an amount of 4 μl.

Detector: FID (split ratio: 1:20).

Carrier gas: $N_2$ gas.

Oven temperature:

70° C.–220° C. (heated at a rate of 5° C./min after being standby at 70° C. for 2 minutes)

Injection temperature: 200° C.

Detection temperature: 200° C.

Preparation of Calibration Curve:

A reference sample prepared by adding a target monomer to the same DMF-acetone solution as the sample solution is similarly measured by gas chromatography to determine the value of the weight ratio/area ratio of the monomer and the internal reference DMF.

As colorants usable in the present invention, they may include any suitable pigments or dyes. In the present invention, colorants described below may be used to provide non-magnetic one-component developers of yellow, magenta, cyan and black colors. The developer colorants shown below are known in the art. For example, as black colorants, usable are carbon black, magnetic material, aniline black, acetylene black, lamp black and graphite, or mixtures of any of these, or colorants toned in black by mixing yellow, magenta and cyan colorants shown below.

As yellow colorants, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147, 168 and 180 are preferably used.

As magenta colorants, condensation azo compounds, diketopyroropyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferred.

As cyan colorants, copper phthalocyanine compounds and derivatives thereof, anthraquinone compounds and basic dye lake compounds may be used. Stated specifically, C.I. Pigment Blue 1, 2, 7, 15:1, 15:2, 15:3, 15:4, 60, 62 and 66 are particularly preferred.

These colorants may be used alone. In view of image quality of full-color images, it is more preferable to use dyes and pigments in combination so as to improve their vividness.

As specific examples of the dyes, C.I. Direct Red 1, C.I. Direct Blue 1, C.I. Direct Green 6 and so forth are available.

Any of these may be used in an amount necessary for maintaining the optical density of fixed images, and may be used in an amount of from 0.1 to 60 parts by weight, and preferably from 0.5 to 20 parts by weight based on 100 parts by weight of the binder resin.

The developer used in the present invention may preferably be incorporated with a wax component as a release agent in order to improve releasability at the time of fixing.

The wax component may specifically include the following compounds. For example, they are silicone resin, rosin, modified rosin, aliphatic or alicyclic hydrocarbon resin such as low-molecular-weight polyethylene or low-molecular-weight polypropylene, chlorinated paraffin, paraffin wax and so forth.

In particular, waxes preferably usable are low-molecular-weight polypropylene and modified products thereof, low-molecular-weight polyester and modified products thereof, ester waxes, aliphatic derivatives. Ester waxes are particularly preferred.

From these waxes, waxes may be fractionated by various methods according to the size of their molecular weight. Such waxes may also preferably be used in the present invention. After the fractionation, they may further be subjected to oxidation, block copolymerization or graft modification.

The wax component according to the present invention may preferably be one which is, in cross-sectional observation of developer particles on a transmission electron microscope (TEM), dispersed in the binder resin in the form of substantially spherical and/or spindle-shaped islands in such a state that the wax component and the binder resin are not dissolved in each other.

Of these, examples of typical compounds of more preferable ester waxes are shown below as Ester Wax General Structural Formulas (1) to (6).

Ester Wax General Structural Formula (1)

$$[R_1—COO—(CH_3)_n]—C—[(CH_2)_n—OCO—R_2]_b$$

wherein a and b each represent an integer of 0 to 4, provided that a+b is 4; $R_1$ and $R_2$ each represent an organic group having 1 to 40 carbon atoms, provided that a difference in the number of carbon atoms between $R_1$ and $R_2$ is 10 or more; and n and m each represent an integer of 0 to 15, provided that n and m are not 0 at the same time.

Ester Wax General Structural Formula (2)

$$[R_1—COO—(CH_2)_n—]_a—C—[—(CH_2)_m—OH]_b$$

wherein a and b each represent an integer of 0 to 4, provided that a+b is 4; $R_1$ represents an organic group having 1 to 40 carbon atoms; and n and m each represent an integer of 0 to 15, provided that n and m are not 0 at the same time.

Ester Wax General Structural Formula (3)

$$[R_1—COO—(CH_2)_a]_b—\overset{(R_3)_k}{\overset{|}{C}}—[(CH_2)_a—OCO—R_2]_b$$

wherein a and b each represent an integer of 0 to 3, provided that a+b+k is 4; $R_1$ and $R_2$ each represent an organic group having 1 to 40 carbon atoms, provided that a difference in the number of carbon atoms between $R_1$ and $R_2$ is 10 or more; $R_3$ represents an organic group having 1 or more carbon atoms; and n and m each represent an integer of 0 to 15, provided that n and m are not 0 at the same time.

Ester Wax General Structural Formula (4)

$$R_1—COOR_2$$

wherein $R_1$ and $R_2$ each represent a hydrocarbon group having 1 to 40 carbon atoms; and $R_1$ and $R_2$ may have a number of carbon atoms which is the same or different from each other.

Ester Wax General Structural Formula (5)

$$R_1COO(CH_2)_nOOCR_2$$

wherein $R_1$ and $R_2$ each represent a hydrocarbon group having 1 to 40 carbon atoms; n represents an integer of 2 to 20; and $R_1$ and $R_2$ may have a number of carbon atoms which is the same or different from each other.

Ester Wax General Structural Formula (6)

$$R_1OOC—(CH_2)_nCOOR_2$$

wherein $R_1$ and $R_2$ each represent a hydrocarbon group having 1 to 40 carbon atoms; n represents an integer of 2 to 20; and $R_1$ and $R_2$ may have a number of carbon atoms which is the same or different from each other.

In order to achieve the improvement in releasability at the time of fixing, any of these wax components may be used in an amount of from 2 to 30 parts by weight, and preferably from 5 to 20 parts by weight, based on 100 parts by weight of the developer. If the wax component is less than 2 parts by weight, the release effect as wax can little be brought out. If the wax component is more than 30 parts by weight, though the releasability of the developer can be satisfied, the developer may have poor developing performance to tend to cause a difficulty such that the developer melt-adheres to the surfaces of the developing sleeve (developer-carrying member) and latent-image-bearing member, undesirably.

For the wax component used in the present invention, it is preferable to show, in the DSC curve as measured with a differential scanning calorimeter, a maximum endothermic peak within the region of from 50° C. to 100° C. at the time of heating (temperature rise). The on-set temperature at the starting point of endothermic peaks including this maximum endothermic peak may preferably be 40° C. or above. In particular, it is preferable that the temperature difference between the peak temperature of the maximum endothermic peak and the on-set temperature is within the range of from 7° C. to 50° C.

The use of the wax component capable of melting within the above temperature range in the DSC curve at the time of heating can make other additives have good dispersibility and also the wax component itself can be controlled with ease to bring it into the state of dispersion described above.

Thus, the developer can have a good fixing performance as a matter of course, the release effect attributable to the wax component is exhibited with good efficiency, a sufficient fixing region is ensured, and also any bad influence of conventionally known wax components on developing performance, anti-blocking properties and image forming apparatus can be eliminated. Hence, these performance and properties can dramatically be improved. In particular, since the specific surface area of the developer particles decreases as the developer-particle shape is made spherical, it is very effective to control the state of dispersion of the wax component.

In the present invention, in the DSC measurement, how the wax exchanges heat is measured to observe its behavior. Accordingly, from the principle of measurement, it may preferably be measured with a differential scanning calorimeter of a highly precise, inner-heat input-compensation type. For example, a differential scanning calorimeter DSC-7, manufactured by Perkin-Elmer Corporation, may be used.

A measurement is made according to ASTM D3418-82. As the DSC curve used in the present invention, when the wax component alone is measured, a DSC curve is used which is obtained when temperature is once raised and dropped to take a previous history and thereafter raised at a heating rate of 10° C./min. Also, when the wax component is measured in the state it is contained in the developer particles, a DSC curve is used which is obtained as it is, without taking any previous history.

To produce the developer according to the present invention, known processes such as a melt pulverization process and a polymerization process may be used.

As an example of the melt pulverization process, the binder resin, the wax, the pigment or dye as the colorant, a charge control agent and optionally a magnetic material and other additives are thoroughly mixed using a mixing machine, such as a Henschel mixer, or a ball mill, and then the mixture obtained is melt-kneaded by means of a heat kneading machine, such as a heating roll, a kneader or an extruder to make the resin and so on melt one another, in which a metal compound, the pigment, the dye and the magnetic material are dispersed or dissolved. The kneaded product obtained is cooled to solidify, followed by pulverization and classification. Thus, the developer used in the present invention, comprised of colored resin particles, can be obtained. In the steps of classification, a multi-division classifier may preferably be used in view of production efficiency.

As an example of the polymerization process, the polymerizable monomer, the cross-linking agent, the polymerization initiator, the pigment or dye as the colorant, or a magnetic material, and other additives are mixed and dispersed, and the monomer composition obtained is subjected to suspension polymerization in an aqueous medium in the presence of a suspension dispersion stabilizer to synthesize polymeric colored resin particles, followed by solid-liquid separation, drying and thereafter classification. Thus, the developer used in the present invention can be obtained.

As specific examples of the suspension dispersion stabilizer, it may include, e.g., as inorganic dispersants, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. As organic compounds, it may include, e.g., polyvinyl alcohol, gelatin, methyl cellulose, methyl hydroxypropyl cellulose, ethyl cellulose, carboxymethyl cellulose sodium salt, and starch, any of which may be dispersed in an aqueous phase when used. Any of these dispersion stabilizers may preferably be used in an amount of 0.2 to 10 parts by weight based on 100 parts by weight of the polymerizable monomer.

The glass transition point of the developer depends on how the polymerizable monomer, the cross-linking agent, the polymerization initiator, the polymerization conditions, and so forth, are combined. The developer used in the present invention may preferably have a glass transition point Tg of from 40° C. to 75° C., and more preferably from 50° C. to 70° C. One having a glass transition point Tg lower than 40° C. is undesirable because it may have poor storage stability to cause blocking during its storage. One having a glass transition point Tg higher than 75° C. is also undesirable because the consumption energy of the fixing assembly must be set higher in order to obtain fixed images having a constant gloss, resulting in a large power consumption, and also because the fixing heat energy must sufficiently be imparted to the developer and hence the fixing speed must be set at a low speed to bring about a problem that any printing at a common speed can not be performed.

To measure the glass transition point Tg of the developer used in the present invention, a differential scanning calorimeter of a highly precise, inner-heat input-compensation type, as exemplified by a differential scanning calorimeter DSC-7, manufactured by Perkin-Elmer Corporation, may be used. Measurement is made according to ASTM D3418-82. In the present invention, a DSC curve is used which is obtained when a sample is once heated to take a previous history and thereafter rapidly cooled, and is again heated at a heating rate of 10° C./min in the temperature region of from 0° C. to 200° C.

In the developer used in the present invention, the colored resin particles may preferably be surface-treated with an external additive in order to control the fluidity index and floodability index within the range described previously. As specific examples of the external additive, it may include fine silica powder, hydrophobic-treated fine silica powder, resin particles of various types, and fatty-acid metal salts, any of which may preferably be used alone or in combination of two or more.

In order to control the developer to have the fluidity index and floodability index within the range preferable in the present invention, the fine silica powder usable in the present invention may preferably be one having a specific surface area of 20 $m^2/g$ or more (particularly from 30 to 400 $m^2/g$) as measured by nitrogen gas absorption according to the BET method. The fine silica powder may be used in an amount of from 0.01 to 8 parts by weight, and preferably from 0.1 to 5 parts by weight, based on 100 parts by weight of the developer particles. The fine silica powder, when used in combination with the inorganic powder described later, may further preferably be used in an amount of from 0.5 to 3 parts by weight in total, inclusive of the inorganic powder described later.

For the purposes of making the fine silica powder hydrophobic and to control its chargeability, the fine silica powder may preferably be treated with a surface-treating agent. Specific examples of the surface-treating agent include silicone varnish, modified silicone varnish of various types, silicone oil, modified silicone oil of various types, a silane coupling agent, a silane coupling agent having a functional group, and other organosilicon compound. Any of these treating agents may be used alone or in the form of a mixture.

A lubricant powder may further be added to the developer. The lubricant powder may include fluorine resins such as Teflon and polyvinylidene fluoride; fluorine compounds such as carbon fluoride; fatty acid metal salts such as zinc stearate; fatty acids, and fatty acid derivatives such as fatty acid esters; and molybdenum sulfide.

In order to improve developing performance and running performance of the developer, it is also preferable to add the following inorganic powder. It may include oxides of metals such as magnesium, zinc, aluminum, cerium, cobalt, iron, zirconium, chromium, manganese, strontium, tin and antimony; composite metal oxides such as calcium titanate, magnesium titanate and strontium titanate; metal salts such as calcium carbonate, magnesium carbonate and aluminum carbonate; clay minerals such as kaolin; phosphoric acid compounds such as apatite; silicon compounds such as silicon carbide and silicon nitride; and carbon powders such as carbon black and graphite powder. In particular, fine powder of zinc oxide, aluminum oxide, cobalt oxide, manganese dioxide, strontium titanate or magnesium titanate is preferred.

These inorganic powders may be used as surface-treating agents for controlling the developer to have the fluidity index and floodability index within the range preferable in the present invention. When used, the inorganic powder may be used in any system without any particular limitations, e.g., a system in which it is used alone, it is used in combination with silica, or a plurality of inorganic powders are used in combination with one another.

When the inorganic powder is used, it may be used in an amount of from 0.005 to 2.0 parts by weight, and more preferably from 0.02 to 0.7 part by weight, based on 100 parts by weight of the binder resin.

In addition, in order to maintain the fluidity of the developer in the present invention during its long-running use, it is preferable to use a plurality of the above external additives as fluidity improvers. In particular, from the viewpoint of charging stability, external additives having, e.g., different particle diameters may preferably be used in combination. External additives composed differently may more preferably be used in combination from the same viewpoint.

The above inorganic powder may preferably be present at the developer-particle surfaces. As a specific apparatus for the treatment to make the inorganic powder present at the developer-particle surfaces in this way, there are no particular limitations as long as it can achieve the proper fluidity index and floodability index in the present invention. Known mixing apparatus as shown in Table 3 may be used. As examples of preferable apparatus, they include a Henschel mixer, a Super mixer, a Conical Ribbon Mixer, a Nauta Mixer, a Spiral Mixer, a Lodige Mixer, a Turbulizer, a Cyclomix and a V-type blender. Of these, in order to achieve the proper fluidity index and floodability index in the present invention, the Henschel mixer, the Super mixer and the Ribocorn are particularly preferred.

TABLE 3

Examples of Mixing Apparatus for Developer Production

| Name of apparatus | Manufacturer |
|---|---|
| Henschel mixer | Mitsui Mining & Smelting Co., Ltd. |
| Super mixer | Kawata K.K. |
| Conical Ribbon Mixer | Ohkawara Seisakusho K.K. |
| Nauta Mixer | Hosokawa Micron Corporation |
| Spiral Mixer | Taiheiyo Kiko K.K. |
| Lodige Mixer | Matsubo K.K. |
| Turbulizer | Hosokawa Micron Corporation |
| Cyclomix | Hosokawa Micron Corporation |

As a specific method for the treatment to make such a surface-treating inorganic powder present at the developer-particle surfaces, the colored resin particles and the above hydrophobic-treated fine silica powder, optionally with addition of other inorganic powder and lubricant powder, may sufficiently be mixed by means of any of the above mixing apparatus.

If the treatment is insufficient or the quantity of the surface-treating inorganic powder is not proper, the proper fluidity index and floodability index in the present invention can not be achieved, and hence proper treatment must be carried out.

Mixing conditions for achieving the proper fluidity index and floodability index in the present invention are described here using the Henschel mixer. To adjust the treatment strength of the Henschel mixer, the type of agitation blades, can be changed the disposition of baffles for preventing the developer from co-turning and for achieving an appropriate strength can be changed, or the number of revolutions and time of rotation of the agitation blades can be adjusted. More specific treatment methods are described in Examples given below.

EXAMPLES

The present invention is specifically described below by the following examples. The present invention is by no means limited to these examples only.

In the following formulation, "part(s)" refers to "part(s) by weight" in all occurrences.

Example 1

Developer Production Example 1

Into a 2-liter four-necked flask having a high-speed stirrer TK-type homomixer (manufactured by Tokushu Kika Kogyo), an aqueous $Na_3PO_4$ solution was introduced, which was then heated to 63° C. with stirring at a number of revolution adjusted to 9,000 rpm. Then, an aqueous $CaCl_2$ solution was slowly added thereto to prepare an aqueous dispersion medium containing fine-particle slightly water-soluble dispersant $Ca_3(PO_4)_2$.

| | |
|---|---|
| Styrene monomer | 80 parts |
| 2-Ethylhexyl acrylate monomer | 20 parts |
| Divinylbenzene monomer | 0.1 part |
| Saturated polyester resin (terephthalic acid-propylene oxide modified bisphenol A; acid value: 15 mg · KOH/8) | 10 parts |
| Carbon black (primary particle diameter: 40 nm) | 8 parts |
| Release agent (behenyl behenate) | 10 parts |
| Aluminum complex of benzilic acid | 2.0 parts |

Meanwhile, the above materials were dispersed for 3 hours by means of a ball mill, and thereafter its contents were isolated from the ball mill. To the contents, 3 parts of a polymerization initiator 2,2'-azobis(2,4-dimethylvaleronitrile) was added to obtain a polymerizable monomer composition, which was then put into the above aqueous dispersion medium to carry out granulation while maintaining the number of revolutions of the high-speed stirrer at 9,000 rpm. Thereafter, the reaction was carried out at 65° C. for 4 hours with stirring by means of paddle stirring blades, and thereafter polymerization was carried out at 80° C. for 5 hours, followed by distillation at 80° C. under reduced pressure of 13.3 kPa (100 Torr) or less.

After the reaction was completed, the suspension obtained was cooled, and hydrochloric acid was added thereto to remove the slightly water-soluble dispersant $Ca_3(PO_4)_2$, followed by filtration, water washing and drying, and further followed by air classification to classify particles to the desired particle size, thus obtaining colored resin particles (1).

100 parts of the colored resin particles (1) and, as fluidity improvers, 1.5 parts of hydrophobic fine silica powder with a BET specific surface area of 130 $m^2/g$ having been treated with hexamethyldisilazane and 0.2 parts of titanium oxide with a primary particle diameter of 150 nm were charged into Henschel mixer, manufactured by Mitsui Mining & Smelting Co., Ltd. As the Henschel mixer, used was one which was so set that its baffle was at an angle of 90 degrees to the peripheral direction of the agitation blades and the number of revolutions came to 1,800 rpm.

Using this mixer, mixing was carried out for 20 minutes to synthesize a developer (1) used in the present invention.

This developer (1) had an angle of repose of 24.1 degrees, a degree of compression of 8.95, a spatula angle of 57.1 and a degree of agglomeration of 2.5. Its Carr's fluidity index found from these values was 78. It also had an angle of rupture of 9.5 degrees, a difference angle of 14.6 degrees, a dispersibility of 76.7. Its Carr's floodability index found from these values was 90.

The developer (1) also had a circle-corresponding average particle diameter D1 of 6.55 $\mu$m, an average circularity of 0.972 and a circularity standard deviation

Examples 2 to 4

Developer Production Examples 2 to 4

Colored resin particles (2) to (4) and then developers (2) to (4) were produced in the same manner as in Example 1, except that in place of the carbon black, the colorants shown in Table 4 was used.

Example 5

Developer Production Example 5

Colored resin particles (5) and then a developer (5) were produced in the same manner as in Example 1, except that stearyl stearate was used as the release agent, in place of Henschel mixer, a Cyclomix was used, and as the fluidity improvers 1.3 parts of hydrophobic fine silica powder with a BET specific surface area of 130 $m^2/g$ and 0.5 parts of magnesium oxide with a primary particle diameter of 150 nm were used.

Examples 6 to 8

Developer Production Examples 6 to 8

Colored resin particles (6) to (8) and then developers (6) to (8) were produced in the same manner as in Example 5, except that the type of the colorant and the quantities of the fluidity improvers used were changed as shown in Table 4.

Example 9

Developer Production Example 9

Polyester resin (1) (polyester resin formed from polyoxypropylene(2.2)-2,2-bis(4-hydroxyphenyl)propane, terephthalic acid, fumaric acid and trimellitic acid; acid value: 10.3 mg×KOH/g; Tg: 56° C.; Mn:

| | |
|---|---|
| 3,900: Mw: 12,700; Tm: 90° C.) | 70 parts |
| Carbon black (primary particle diameter: 40 nm) | 70 parts |

The above materials were charged into a kneader-type mixer, and then heated to 120° C. with mixing under no pressure applied to premix them well. Thereafter, the mixture formed was kneaded twice by means of a three-roll mill to obtain a first kneaded product.

| | |
|---|---|
| First kneaded product above | 16.7 parts |
| Polyester resin (1) above | 88.3 parts |
| Release agent (polyethylene derivative; Mn: 1,000; acid value: 0.6 mg × KOH/g) | 10 parts |
| Aluminum complex of benzilic acid | 4 parts |

The above materials were sufficiently premixed by means of the Henschel mixer, and the mixture formed was melt-kneaded by means of a twin-screw extruder. The kneaded product obtained was cooled and thereafter crushed using a hammer mill to have diameters of about 1 mm to 2 mm. Then, the resultant crushed product was pulverized by means of a fine grinding mill of an air-jet system. The pulverized product obtained was put to a multi-division classifier to strictly remove fine powder and coarse powder simultaneously. Thereafter, using a surface-modifying apparatus of a system in which rotors are rotated to impart mechanical impact force, the pulverized product was surface-treated at 1,600 rpm (peripheral speed: 80 m/sec.) for 3 minutes by a bath method, followed by classification by means of the multi-division classifier to obtain colored resin particles (9).

To 100 parts of the colored resin particles (9), 2.0 parts of hydrophobic fine silica powder with a BET specific surface area of 200 $m^2/g$ and 0.2 parts of strontium titanate with a BET specific surface area of 2.8 $m^2/g$ were externally added using the Henschel mixer to synthesize a developer (9).

This developer (9) had a fluidity index of 71 and a floodability 77. It also had a circle-corresponding average particle diameter D1 of 7.70 mm, an average circularity of 0.965 and a circularity standard deviation of 0.036.

Examples 10 to 12

Developer Production Examples 10 to 12

Colored resin particles (10) to (12) and then developers (10) to (12) were produced in the same manner as in Example 9, except that the formulation was changed as shown in Table 4.

Example 13

Developer Production Example 13

The colored resin particles (9) obtained in Example 9 were subjected to treatment using as the fluidity improvers 0.8 part of hydrophobic fine silica powder with a BET specific surface area of 130 $m^2/g$ and 0.3 parts of resin particles (1) (polymethyl methacrylate particles with an average particle diameter of 0.2 mm, positively chargeable to the developer particles) and by means of a Super mixer to obtain a developer (13).

Example 14

Developer Production Example 14

A developer (14) was produced in the same manner as in Example 13, except that in place of the resin particles (1) 0.3 parts of resin particles (2) (polystyrene particles with an average particle diameter of about 0.2 mm, negatively chargeable to the developer particles) was used.

Example 15

Developer Production Example 15

A developer (15) was produced in the same manner as in Example 13 except that in place of the resin particles (1) 0.3 part of resin particles (3) (polystyrene particles with an average particle diameter of about 0.2 mm, positively chargeable to the developer particles) was used.

Example 16

Developer Production Example 16

A developer (16) was produced in the same manner as in Example 13, except that in place of the resin particles (1) 0.3 parts of resin particles (4) (polystyrene particles with an average particle diameter of about 0.4 $\mu$m, positively chargeable to the developer particles) was used.

Example 17

Developer Production Example 17

A developer (17) was synthesized in the same manner as in Example 13, except that as the fluidity improvers 0.8 parts of titanium oxide with a BET specific surface area of 40 $m^2/g$ and 0.3 parts of aluminum oxide were used.

Example 18

Developer Production Example 18

A developer (18) was synthesized in the same manner as in Example 13, except that as the fluidity improvers 0.8 parts of titanium oxide with a BET specific surface area of 40 $m^2/g$ and 0.3 parts of Teflon particles were used.

Developer Comparative

Production Example 1

The colored resin particles (9) obtained in Example 9 were subjected to treatment by external addition, using as the fluidity improvers, 0.8 parts of fine silica powder with a BET specific surface area of 130 $m^2/g$ and 0.1 parts of aluminum oxide with a BET specific surface area of 27 $m^2$ $\mu$g and by means of a Conical Ribbon Mixer to obtain a comparative developer (1). This comparative developer (1) had a fluidity index of 35 and a floodability index of 40.

Developer Comparative

Production Example 2

Comparative colored resin particles (2) were synthesized in the same manner as in Example 9, except that as the release agent 4 parts of low-molecular-weight polypropylene (DSC endothermic peak: 107° C.) was used. A comparative developer (2) was produced in the same manner as in Developer Comparative Production Example 1, except that, to the comparative colored resin particles (2), 0.4 parts of hydrophobic fine silica powder with a BET specific surface area of 50 $m^2/g$ and 0.1 parts of aluminum oxide were added as the fluidity improvers.

Developer Comparative

Production Examples 3 to 5

Comparative developers (3) to (5) were produced in the same manner as in Developer Comparative Production Example 2, except that the formulation was changed as shown in Table 5.

Developer Comparative

Production Example 6

Comparative colored resin particles (6) were obtained in the same manner as in Example 1 except that, in producing the colored resin particles (1), the number of revolutions in the granulation was changed to 4,000 rpm. The comparative colored resin particles (6) were subjected to surface treatment using as the surface-treating agent shown in Table 5 and by means of a Cyclomix to obtain a comparative developer (6).

Developer Comparative

Production Example 7

A comparative developer (7) was produced in the same manner as in Developer Comparative Production Example 1, except that the comparative color resin particles (1) obtained in Example 1 were subjected to treatment with the surface-treating agent shown in Table 5.

The formulation and physical properties of the developers used in Examples and Comparative Examples are shown in Tables 4 and 5.

Example 19

Evaluation 1

An evaluation was made using the image-forming apparatus shown in FIG. 1, described previously. In the apparatus shown in FIG. 1, the agitation blades 120*a* and 120*b* of the rotary agitation and transport means were made of polyester (PE) film, and were 200 mm in thickness each. These agitation blades were joined to agitation shafts 121*a* and 121*b* made of polyacetal by ultrasonic caulking to make the both integral. The agitation blades 120*a* and 120*b* are rotated in the clockwise direction in FIG. 3 to agitate the developer and transport it toward the developer-carrying member. Accordingly, as to their periods, the periods were controlled by an external drive so that both of them do not interfere with each other at the part where they cross at the middle. In this image-forming apparatus, the value of S2/S1 was 0.96. In the circumparallelogram taking a minimum area in respect to the area S1 at the part holding the developer, its long side Sa was 72 mm, the short side Sb was 34 mm, and the ratio of Sa to Sb, Sa/Sb, was 2.1.

In this Example, development was performed under the following setting.

(a) The process speed was so set as to be 94 mm/s.

(b) As the charging system of the apparatus, the direct charging performed by bringing the rubber roller into contact was employed, and as the applied voltage a voltage of DC component (−1,200 V) was applied.

(c) As the developer-carrying member, a medium-resistance rubber roller comprised of silicone rubber with carbon black dispersed therein (diameter: 16 mm; Asker-C hardness: 40 degrees; resistance: $10^5$ Ω·cm) was used, and was so set as to come into pressure contact with the photosensitive member (latent-image-bearing member).

(d) The developer-carrying member was rotated in the forward direction at the part contacting the photosensitive member, and was so driven as to be at a peripheral speed which was 40% with respect to the peripheral speed of the rotation of the photosensitive member.

(e) As the latent-image-bearing member, the following photosensitive member was used. The photosensitive member used here was one making use of an aluminum cylinder of 30 mm in diameter and 254 mm in length as a substrate, on which layers with the construction as shown below were successively formed in layers by dip coating.

(1) Conductive coating layer: Composed chiefly of powders of tin oxide and titanium oxide dispersed in phenol resin. Layer thickness: 15 $\mu$m.

(2) Subbing layer: Composed chiefly of a modified nylon and a copolymer nylon. Layer thickness: 0.6 $\mu$m.

(3) Charge generation layer: Composed chiefly of a titanyl phthalocyanine pigment having absorption in long wavelength range, dispersed in butyral resin. Layer thickness: 0.6 $\mu$m.

(4) Charge transport layer: Composed chiefly of a hole-transporting triphenylamine compound dissolved in polycarbonate resin (molecular weight: 20,000 as measured by Ostwald viscometry) in a weight ratio of 8:10. Layer thickness: 20 $\mu$m.

(f) In the charging of the photosensitive member, a roller charging assembly was used, and only direct current was applied to set the charge potential at −580 V.

(g) For the developer-coat-layer control on the developer-carrying member, a resin-coated blade made of phosphor bronze was so attached that it came into pressure contact with the developer-carrying member at a linear pressure of about 20 g/cm.

(h) As the applied voltage at the time of development, only a DC component (−450 V) was applied.

Using this image-forming apparatus and using the developer (1) obtained in Example 1, a 6,000-sheet running test (durability test) was conducted under conditions of a temperature 23° C. and a humidity 55%, and an evaluation was made on the following items. Here, the running test was conducted using CLC paper available from CANON INC., by printing a horizontal-line pattern image having a print area percentage of 6%. The results of evaluation are shown in Table 6.

(1) Stability of Image Density:

Full-solid images were sampled at constant intervals in the course of the running test. Any difference in the whole density scattering of the full-solid images was examined and was used as an index for the evaluation of developer circulation. Here, the image density was measured with a MACBETH REFLECTION DENSITOMETER (manufactured by Macbeth Co.), as relative density with respect to an image printed on a white ground area with a density of 0.00 of an original.

AA (excellent): The difference in density is less than 0.1.

A (good): The difference in density is 0.1 or more to less than 0.3.

B (passable): The difference in density is 0.3 or more to less than 0.5.

C (failure): The difference in density is 0.5 or more.

(2) Image Fog:

Fog density (%) was calculated from a difference between the whiteness at a white background area of printed images and the whiteness of the transfer paper to make an evaluation of image fog, which was measured with REFLECTOMETER (manufactured by Tokyo Denshoku Co., Ltd.).

AA: Very good (less than 1.5%).

A: Good (1.5% or more to less than 2.5%).

B: Feasible for practical use (2.5% or more to less than 4.0%).

C: Infeasible for practical use (4% or more).

(3) Running Lifetime:

The number of sheets by which a decrease in density occurred because of insufficient feed of developer when the process cartridge was used in the running test was judged according to the following criteria from the estimated lifetime of the process cartridge.

AA: Very good (the estimated lifetime is satisfied).

A: Good (95% or more of the estimated lifetime).

B: Feasible for practical use (85% or more to less than 95% of the estimated lifetime).

C: Infeasible for practical use (85% or less of the estimated lifetime).

(4) Solidification of Developer:

After the running test was finished, the developer in the developing container was collected in a quantity of 2.0 g, and put on a sieve with a mesh of 154 $\mu$m, where a vibration was applied at an oscillation of 1 mm. From the residue on the sieve after that, a judgement was made according to the following criteria.

AA: Very good (solid matter does not remain at all).

A: Good (solid matter is less than 1%).

B: Feasible for practical use (solid matter is 1% or more to less than 2%).

C: Infeasible for practical use (solid matter is 2% or more).

(5) Developer Dropping:

Any image defects due to developer dropping on images during the running were visually evaluated.

AA: Very good (any dropping is not seen at all).

A: Good (dropping is slightly seen, but on a level not problematic in practical use).

B: Feasible for practical use (dropping is seen, but on a level feasible for practical use).

C: Infeasible for practical use (dropping is greatly seen, and on a level infeasible for practical use).

(6) Developer Scattering:

After the running test was finished, the process cartridge was observed, and the level of occurrence of any in-machine contamination due to the scattering or leakage of the developer was visually evaluated according to the following criteria.

AA: Very good (any contamination is not seen at all).

A: Good (contamination is slightly seen, but on a level not problematic in practical use).

B: Feasible for practical use (contamination is seen, but on a level feasible for practical use).

C: Infeasible for practical use (contamination is greatly seen, and on a level infeasible for practical use).

Examples 20 to 22

Evaluation 2 to 4

Evaluation was made in the same manner as in Example 19 except that in place of the developer (1) the developers shown in Table 6 were used. The results of evaluation are shown in Table 6.

Comparative Examples 1 to 4

An evaluation was made in the same manner as in Example 19, except that in place of the developer (1) the developers shown in Table 6 were used. The results of evaluation are shown in Table 6.

Comparative Example 5

Figure 7:
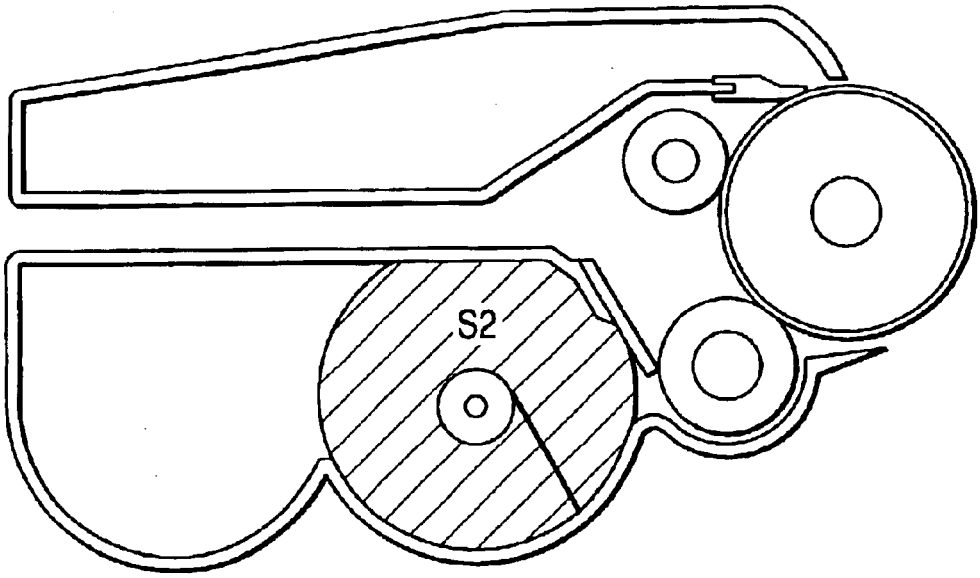
FIG. 7 is a schematic sectional view of the developing assembly part of a process cartridge used in Comparative Example 5.

An evaluation was made in the same manner as in Example 19, except that the part of the developing assembly of the process cartridge used in Example 19 was changed for a developing assembly whose agitation means was so modified that the value of S2/S1 came to 0.484 (FIG. 7). The results of evaluation are shown in Table 6.

Comparative Example 6

Figure 8:
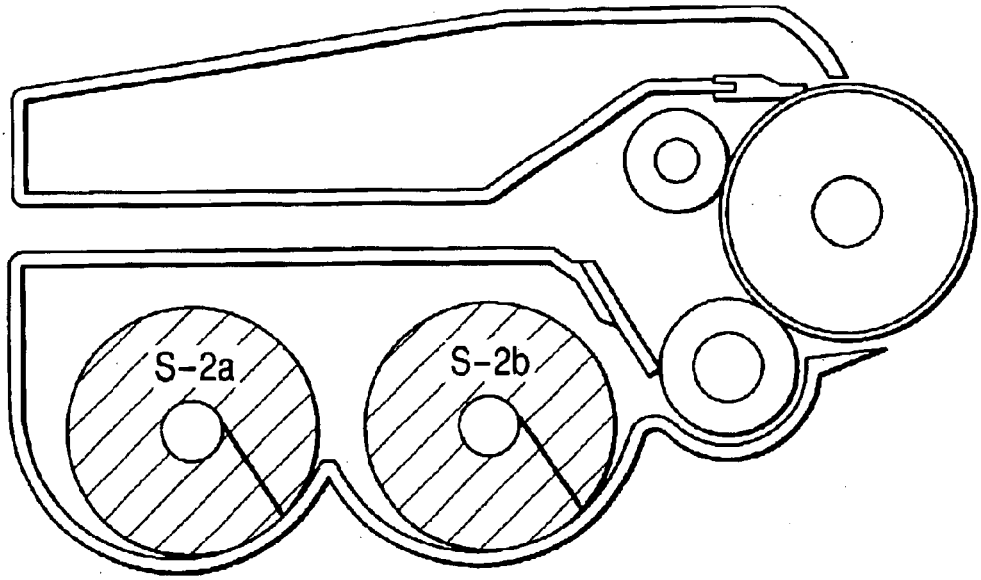
FIG. 8 is a schematic sectional view of the developing assembly part of a process cartridge used in Comparative Example 6.

An evaluation was made in the same manner as in Example 19, except that the part of the developing assembly of the process cartridge used in Example 19 was changed for a developing assembly whose agitation means was so modified that the value of S2/S1 came to 0.58 (FIG. 8). The results of evaluation are shown in Table 6.

In all Examples 19 to 22, the results of evaluation are good. This is considered to be the outcome of the fact that the developer has an appropriate fluidity index and floodability index, has so proper a relationship with the developer container that the developer can be prevented from solidifying during the running test, and also can properly be agitated inside the developer container, and these points have cooperatively acted.

Example 23

Evaluation 5

Figure 9:
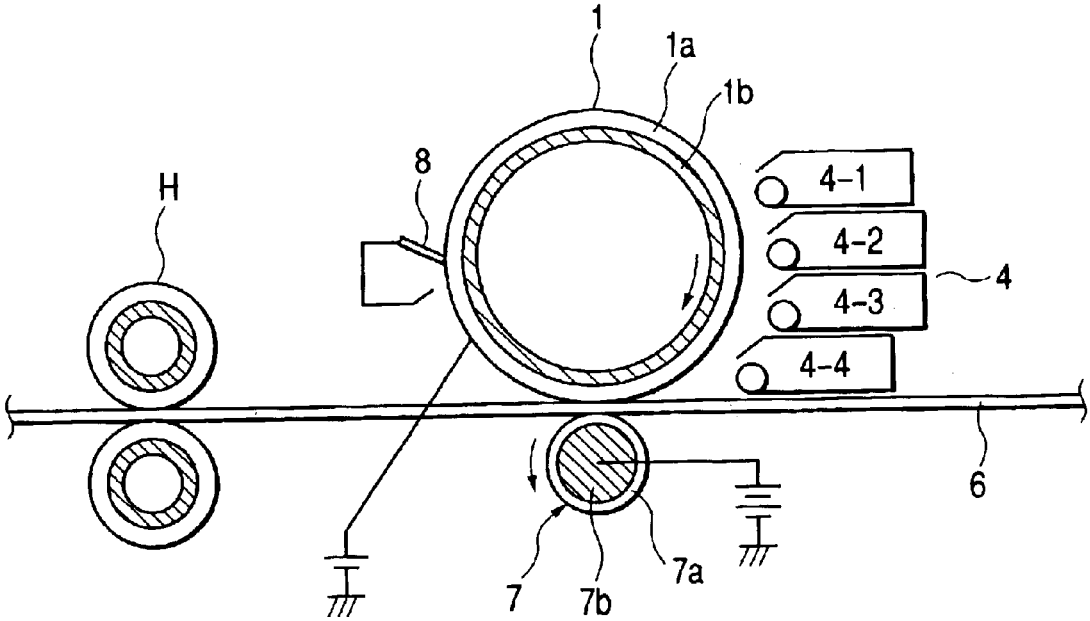
FIG. 9 is a schematic sectional view showing an example of a full-color image-forming apparatus making use of an intermediate transfer member, in which the developer and process cartridge of the present invention are used.

FIG. 9 is a schematic sectional view of an example of an image-forming apparatus making use of an intermediate transfer mechanism used in this Example 23. In the image-forming apparatus shown in FIG. 9, the same process cartridge as that shown in FIG. 1 is used in each process cartridge 4. Developing assemblies filled respectively with black, magenta, cyan and yellow developers are put into process cartridges 4-1, 4-2, 4-3 and 4-4, respectively. Toner images rendered visible on latent-image-bearing members (photosensitive members) of these developing assemblies by a non-magnetic one-component contact system are one after another transferred onto an intermediate transfer member 1, so that a color image is synthesized. The color image held on the intermediate transfer member 1 is finally one time transferred onto a transfer material 6 by means of a transfer roller 7, and then fixed by means of a heat fixing assembly H. Incidentally, the image-forming apparatus has a residual-developer removal means 8.

The intermediate transfer member 1 has a pipe-like mandrel 1*b* and an elastic or coat layer 1*a* provided thereon by coating, formed of nitrile-butadiene rubber (NBR) in which a conductivity-providing agent carbon black has well been dispersed. The coat layer (elastic layer) 1*a* thus formed has a hardness according to JIS K-6301, of 20 degrees and a volume resistivity of $10^9$ Ω·cm. In this experiment, the transfer from the photosensitive members to the intermediate transfer member 1 was performed under the application of a voltage of +700 v to the mandrel 1*b* from a power source.

The transfer roller 7 has an outer diameter of 20 mm. The transfer roller 7 has a mandrel 7*b* of 10 mm in diameter and an elastic layer 7*a* formed thereon by coating a foamable material of an ethylene-propylenediene terpolymer (EPDM) in which a conductivity-providing agent carbon black has well been dispersed. As the elastic layer 7*a*, one showing the values of a volume resistivity of $10^6$ Ω·cm and a hardness according to JIS K-6301, of 35 degrees was used. A voltage was applied to the transfer roller to flow a transfer current of 11 μA.

In the heat fixing assembly H, a fixing assembly of a hot-roll type having no function of oil application was used. Also, the developers (1) to (4) obtained in Examples 1 to 4 were used in the process cartridges 4-1, 4-2, 4-3 and 4-4, respectively.

Under the above conditions, a running test was conducted in an environment of a temperature 25° C. and a humidity 55% by continuously printing an image with a print area percentage of 4%, on 8,000 sheets at a paper feed rate of 8 sheets(A4-size)/minute, and an evaluation was made on the evaluation items (1), (2) and (4) to (6). The results of evaluation are shown in Table 7.

Examples 24 and 25

Evaluation 6 and 7

An evaluation was made in the same manner as in Example 23, except that the developers were changed for those shown in Table 7. The results of evaluation are shown in Table 7.

Comparative Example 7

An evaluation was made in the same manner as in Example 23 except that the developer was changed for the one shown in Table 7. The results of evaluation are shown in Table 7.

TABLE 4

| | Developer | Colored resin particle | | | | Surface-treating agents 1 | |
|---|---|---|---|---|---|---|---|
| Example | No. | Resin component | Colorant | Amount | Release Agent | Type | Amount |
| 1 | 1 | Styrene-acrylic | Carbon Black | 8 | Behenyl behenate | Hb silica (130 $m^2/g$) | 1.5 |
| 2 | 2 | Styrene-acrylic | C.I. Pig. Red | 6 | Behenyl behenate | Hb silica (130 $m^2/g$) | 1.5 |
| 3 | 3 | Styrene-acrylic | C.I. Pig. Blue | 6 | Behenyl behenate | Hb silica (130 $m^2/g$) | 1.5 |
| 4 | 4 | Styrene-acrylic | C.I. Pig. Yellow | 6 | Behenyl behenate | Hb silica (130 $m^2/g$) | 1.5 |
| 5 | 5 | Styrene-acrylic | Carbon Black | 8 | Stearyl stearate | Hb silica (130 $m^2/g$) | 1.3 |
| 6 | 6 | Styrene-acrylic | C.I. Pig. Red | 6 | Stearyl stearate | Hb silica (200 $m^2/g$) | 1.6 |
| 7 | 7 | Styrene-acrylic | C.I. Pig. Blue | 6 | Stearyl stearate | Hb silica (200 $m^2/g$) | 1.1 |
| 8 | 8 | Styrene-acrylic | C.I. Pig. Yellow | 6 | Stearyl stearate | Hb silica (200 $m^2/g$) | 1.3 |
| 9 | 9 | Polyester type | Carbon Black | 6 | Low-mol. Wt. PE | Hb silica (200 $m^2/g$) | 2 |
| 10 | 10 | Polyester type | C.I. Pig. Red | 5 | Low-mol. Wt. PE | Hb silica (200 $m^2/g$) | 1.6 |
| 11 | 11 | Polyester type | C.I. Pig. Blue | 5 | Low-mol. Wt. PE | Hb silica (200 $m^2/g$) | 1.3 |
| 12 | 12 | Polyester type | C.I. Pig. Yellow | 5 | Low-mol. Wt. PE | Hb silica (200 $m^2/g$) | 0.8 |
| 13 | 13 | Polyester type | Carbon black | 8 | Low-mol. Wt. PE | Hb silica (130 $m^2/g$) | 1.3 |
| 14 | 14 | Polyester type | Carbon black | 8 | Low-mol. Wt. PE | Hb silica (130 $m^2/g$) | 1.3 |
| 15 | 15 | Polyester type | Carbon black | 8 | Low-mol. Wt. PE | Hb silica (130 $m^2/g$) | 1.3 |

| | Surface-treating agent 2 | | Surface-treating | Fluidity | Flood-ability | Particle shape | | |
|---|---|---|---|---|---|---|---|---|
| Example | Type | Amount | apparatus | index | index | Circularity-corresponding diameter | Average circularity | Circularity deviation |
| 1 | Ti oxide | 0.2 | Henschel mixer | 78 | 90 | 6.55 | 0.972 | 0.038 |
| 2 | Ti oxide | 0.2 | Henschel mixer | 76 | 89 | 7.20 | 0.974 | 0.036 |
| 3 | Ti oxide | 0.2 | Henschel mixer | 78 | 91 | 7.50 | 0.972 | 0.039 |
| 4 | Ti oxide | 0.2 | Henschel mixer | 77 | 89 | 7.90 | 0.975 | 0.039 |
| 5 | Mg oxide | 0.5 | Cyclomix | 76 | 81 | 6.60 | 0.957 | 0.038 |
| 6 | Al oxide | 0.02 | Cyclomix | 75 | 83 | 7.25 | 0.962 | 0.038 |
| 7 | Al oxide | 0.7 | Cyclomix | 75 | 82 | 6.90 | 0.975 | 0.037 |
| 8 | Al oxide | 0.4 | Cyclomix | 75 | 82 | 6.85 | 0.972 | 0.038 |
| 9 | Sr titanate | 0.2 | Super mixer | 71 | 81 | 7.70 | 0.973 | 0.036 |
| 10 | Sr titanate | 0.5 | Super mixer | 67 | 81 | 6.52 | 0.965 | 0.035 |
| 11 | Sr titanate | 0.7 | Super mixer | 70 | 71 | 6.91 | 0.981 | 0.036 |
| 12 | Sr titanate | 0.7 | Super mixer | 67 | 74 | 6.90 | 0.980 | 0.036 |
| 13 | Resin particles (1) | 0.3 | Cyclomix | 76 | 75 | 6.75 | 0.978 | 0.037 |

TABLE 4-continued

| | | | | | | | | |
|---|---|---|---|---|---|---|---|---|
| 14 | Resin particles (2) | 0.3 | Cyclomix | 55 | 58 | 4.65 | 0.973 | 0.036 |
| 15 | Resin particles (3) | 0.3 | Cyclomix | 68 | 69 | 8.20 | 0.975 | 0.035 |

Hb: Hydrophobic

TABLE 5

| | Developer | Colored resin particle | | | | Surface-treating agents 1 | |
|---|---|---|---|---|---|---|---|
| | No. | Resin component | Colorant | Amount | Release Agent | Type | Amount |
| Ex. 16 | 16 | Polyester type | Carbon black | 8 | Low-mol. wt. PE | Hb silica (130 $m^2/g$) | 1.3 |
| Ex. 17 | 17 | Polyester type | Carbon black | 8 | Low-mol. wt. PE | Ti Oxide | 0.8 |
| Ex. 18 | 18 | Polyester type | Carbon black | 8 | Low-mol. wt. PE | Ti Oxide | 0.8 |
| Comp. Ex. 1 | 19 | Polyester type | Carbon black | 8 | Low-mol. wt. PE | Untreated silica (130 $m^2/g$) | 0.4 |
| Comp. Ex. 2 | 20 | Polyester type | Carbon black | 10 | Low-mol. wt. PP | Hb silica (50 $m^2/g$) | 0.4 |
| Comp. Ex. 3 | 21 | Polyester type | C.I. Pig. Red | 6 | Low-mol. wt. PP | Hb silica (50 $m^2/g$) | 0.5 |
| Comp. Ex. 4 | 22 | Polyester type | C.I. Pig. Blue | 6 | Low-mol. wt. PP | Hb silica (50 $m^2/g$) | 0.5 |
| Comp. Ex. 5 | 23 | Polyester type | C.I. Pig. Yellow | 6 | Low-mol. wt. PP | Hb silica (50 $m^2/g$) | 0.5 |
| Comp. Ex. 6 | 24 | Styrene-acrylic | Carbon black | 8 | Behenyl behenate | Hb silica (200 $m^2g$) | 5.5 |
| Comp. Ex. 7 | 25 | Styrene-acrylic | Carbon black | 8 | Low-mol. wt. PP | Sr titanate | 0.7 |

| | Surface-treating agent 2 | | Surface-treating | Fluidity | Flood-ability | Particle shape | | |
|---|---|---|---|---|---|---|---|---|
| | Type | Amount | apparatus | index | index | Circularity-corresponding diameter | Average circularity | Circularity deviation |
| Ex. 16 | Resin particles (4) | 0.3 | Cyclomix | 69 | 62 | 8.11 | 0.981 | 0.034 |
| Ex. 17 | Al oxide | 0.3 | Cyclomix | 53 | 57 | 6.10 | 0.976 | 0.031 |
| Ex. 18 | Teflon particles | 0.3 | Cyclomix | 52 | 46 | 5.70 | 0.972 | 0.030 |
| Comp. Ex. 1 | Al oxide | 0.1 | Conical Ribbon Mixer | 35 | 40 | 6.20 | 0.920 | 0.033 |
| Comp. Ex. 2 | Al oxide | 0.1 | Conical Ribbon Mixer | 46 | 44 | 7.50 | 0.940 | 0.041 |
| Comp. Ex. 3 | Al oxide | 0.2 | Conical Ribbon Mixer | 45 | 42 | 7.20 | 0.928 | 0.042 |
| Comp. Ex. 4 | Al oxide | 0.1 | Conical Ribbon Mixer | 38 | 43 | 6.80 | 0.943 | 0.044 |
| Comp. Ex. 5 | — | — | Conical Ribbon Mixer | 30 | 31 | 5.50 | 0.915 | 0.041 |
| Comp. Ex. 6 | — | — | Cyclomix | 91 | 97 | 11.0 | 0.955 | 0.020 |
| Comp. Ex. 7 | — | — | Conical Ribbon Mixer | 43 | 43 | 6.50 | 0.975 | 0.039 |

Hb: Hydrophobic

TABLE 6

| | Developer | Colored resin particle | | | | | | Running | Developer | | |
|---|---|---|---|---|---|---|---|---|---|---|---|
| | No. | Resin component | Colorant | Amt. | Release Agent | Density | Fog | Lifetime | Developer solidification | Dropping | Scattering |
| Ex. 19 | 1 | Styrene-acrylic | Carbon black | 8 | Behenyl behenate | AA | AA | AA | AA | AA | AA |
| Ex. 20 | 5 | Styrene-acrylic | Carbon black | 8 | Stearyl stearate | AA | AA | AA | AA | AA | AA |
| Ex. 21 | 9 | Polyester type | Carbon black | 6 | Low-mol. wt. PE | AA | AA | AA | AA | AA | AA |
| Ex. 22 | 13 | Polyester type | Carbon black | 8 | Low-mol. wt. PE | AA | AA | A | AA | AA | A |
| Comp. Ex. 1 | 19 | Polyester type | Carbon black | 8 | Low-mol. wt. PE | C | C | C | C | C | C |
| Comp. Ex. 2 | 20 | Polyester type | Carbon black | 10 | Low-mol. wt. PP | C | C | C | C | C | C |
| Comp. Ex. 3 | 24 | Styrene-acrylic | Carbon black | 8 | Behenyl behenate | C | B | C | C | C | C |

TABLE 6-continued

| | Developer | Colored resin particle | | | | | | Running | Developer | | |
|---|---|---|---|---|---|---|---|---|---|---|---|
| | No. | Resin component | Colorant | Amt. | Release Agent | Density | Fog | Lifetime | Developer solidification | Dropping | Scattering |
| Comp. Ex. 4 | 25 | Styrene-acrylic | Carbon black | 8 | Low-mol. wt. PP | B | C | C | C | C | C |
| Comp. Ex. 5 | 1 | Styrene-acrylic | Carbon black | 8 | Behenyl behenate | B | A | C | C | B | B |
| Comp. Ex. 6 | 1 | Styrene-acrylic | Carbon black | 8 | Behenyl behenate | A | A | C | C | B | B |

TABLE 7

| | Developer | Colored resin particle | | | | | Developer | | | |
|---|---|---|---|---|---|---|---|---|---|---|
| | No. | Resin component | Colorant | Amount | Density | Fog | Developer solidification | How agglomerate after running | Dropping | Scattering |
| Ex. 23 | 1 | Styrene-acrylic | Carbon black | 8 | AA | AA | AA | | AA | AA |
| | 2 | Styrene-acrylic | C.I. Pig. Red | 6 | AA | AA | AA | | AA | AA |
| | 3 | Styrene-acrylic | C.I. Pig. Blue | 6 | AA | AA | AA | | AA | AA |
| | 4 | Styrene-acrylic | C.I. Pig. Yellow | 6 | AA | AA | AA | | AA | AA |
| Ex. 24 | 5 | Styrene-acrylic | Carbon black | 8 | AA | AA | AA | | AA | AA |
| | 6 | Styrene-acrylic | C.I. Pig. Red | 6 | AA | AA | AA | | AA | AA |
| | 7 | Styrene-acrylic | C.I. Pig. Blue | 6 | AA | AA | AA | | AA | AA |
| | 8 | Styrene-acrylic | C.I. Pig. Yellow | 6 | AA | AA | AA | | AA | AA |
| Ex. 25 | 9 | Polyester type | Carbon black | 6 | A | AA | | A | AA | AA |
| | 10 | Polyester type | C.I. Pig. Red | 5 | A | AA | | A | AA | AA |
| | 11 | Polyester type | C.I. Pig. Blue | 5 | A | AA | | A | AA | AA |
| | 12 | Polyester type | C.I. Pig. Yellow | 10 | A | AA | | A | AA | AA |
| Comp. | 20 | Polyester type | Carbon black | 10 | B | C | | C | C | C |
| Ex. 7 | 21 | Polyester type | C.I. Pig. Red | 6 | C | C | | C | C | C |
| | 22 | Polyester type | C.I. Pig. Blue | 6 | C | C | | C | C | C |
| | 23 | Polyester type | C.I. Pig. Yellow | 6 | C | C | | C | C | C |

What is claimed is:

1. An integral-type process cartridge comprising:

a latent-image-bearing member configured to hold thereon an electrostatic latent image; and developing means for rendering visible the electrostatic latent image held on said latent-image-bearing member, by means of a non-magnetic one-component developer to form a toner image, said developing means comprising:

a developer container configured to hold therein said developer and including a bottom part having two concave portions, and an inner wall;

a developer agitation and transport member configured and positioned to agitate said developer held in said developer container, said developer agitation and transport member comprising at least two rotary agitation and transport means for agitating and transporting said developer having rotating shafts and agitation blades;

a developing member configured and positioned to perform development with the developer in pressure contact with said latent-image-bearing member; and a control member configured and positioned to control the quantity of said developer on said developing member, wherein said rotating shafts extend at right angles to a vertical cross section which bisects, in said process cartridge, the surface of said latent-image-bearing member with which said developing member is brought into pressure contact, wherein said agitation blades rub said inner wall of said developer container, wherein said two concave portions in said bottom part of said developer container are opposite to said rotating shafts, wherein the cross sectional area of said developer container at the vertical cross section is represented by S1, wherein the cross sectional area of the part of said developing means corresponding to a movable region of said two rotary agitation and transport means at the vertical cross section is represented by S2, and wherein the ratio S2/S1 is from 0.8 to 0.99, wherein a minimum-area circumparallelogram of area S1 has a long side Sa and a short side Sb, wherein the ratio Sa/Sb is from 1.5 to 3.0, and wherein said non-magnetic one-component developer contains at least a binder resin and a colorant and has a fluidity index of from 50 to 90 and a floodability index of from 45 to 96.

2. The process cartridge according to claim 1, wherein said developer has a fluidity index of from 60 to 80 and a floodability index of from 81 to 90.

3. The process cartridge according to claim 1, wherein said developer further contains a release agent.

4. The process cartridge according to claim 3, wherein said release agent is one of low-molecular-weight polypropylene and a modified product thereof, low-molecular-weight polyester and a modified product thereof, and or an ester wax.

5. The process cartridge according to claim 3, wherein said release agent is an ester wax.

6. The process cartridge according to claim 1, wherein said developer is a non-magnetic one-component developer of the color yellow, magenta, cyan or black.

7. The process cartridge according to claim 1, further comprising removal means, in pressure contact with said latent-image-bearing member, for removing a residual developer having remained on said latent-image-bearing member after the toner image has been transferred to a transfer material.

8. The process cartridge according to claim 1, wherein said developing means further comprises:

a coating member configured and positioned to coat said developer onto said developing member; and a charging auxiliary member configured and positioned to assist the charging of said developer in contact with said developer whose coat weight has been controlled on said developing member.

9. The process cartridge according to claim 8, wherein said charging auxiliary member has the shape of a roller.

10. The process cartridge according to claim 1, wherein said at least two rotary agitation and transport means are rotated in synchronization without any mutual interference.

11. The process cartridge according to claim 1, wherein said developer further contains a silica having been subjected to hydrophobic treatment.

12. The process cartridge according to claim 1, wherein said developer further contains at least two types of fluidity improvers.

13. The process cartridge according to claim 1, wherein, in a number-based circle-corresponding diameter/circularity scatter diagram as measured with a flow type particle image analyzer, the particles of said developer have a circle-corresponding number-average particle diameter D1 of from 2.0 $\mu$m to 10.0 $\mu$m and have an average circularity of from 0.920 to 0.995 and a circularity standard deviation of less than 0.040.

14. The process cartridge according to claim 13, wherein the average circularity of the particles of said developer is from 0.950 to 0.995 and the circularity standard deviation is less than 0.035.

15. The process cartridge according to claim 13, wherein the average circularity of the particles of said developer is from 0.970 to 0.995 and the circularity standard deviation is from 0.015 to 0.035.

16. The process cartridge according to claim 1, further comprising charging means for charging said latent-image-bearing member in contact with said latent-image-bearing member.

17. A developing-assembly unit comprising:

a non-magnetic one-component developer for developing an electrostatic latent image;

a developer container configured to hold therein said developer and including a bottom part having two concave portions, and an inner wall;

a developer agitation and transport member configured and positioned to agitate said developer held in said developer container, said developer agitation and transport member comprising at least two rotary agitation and transport means for agitating and transporting said developer having rotating shafts and agitation blades;

a developing member configured and positioned to carry said developer held in said developer container and to transport said developer to a developing zone where the electrostatic latent image is to be developed, and to perform development in pressure contact with a latent-image-bearing member; and a control member configured and positioned to control the quantity of said developer on said developing member, wherein said rotating shafts extend at right angles to a vertical cross section which bisects, in said developing-assembly unit, the surface of the latent-image-bearing member with which said developing member is brought into pressure contact, wherein said agitation blades rub said inner wall of said developer container, wherein said two concave portions in said bottom part of said developer container are opposite to said rotating shafts, wherein the cross sectional area of said developer container at the vertical cross section is represented by S1, wherein the cross sectional area of the part of said developing means corresponding to a movable region of said two rotary agitation and transport means at the vertical cross section is represented by S2, and wherein the ratio S2/S1, is from 0.8 to 0.99, wherein a minimum-area circumparallelogram of area S1 has a long side Sa and a short side Sb, wherein the ratio Sa/Sb is from 1.5 to 3.0, and wherein said non-magnetic one-component developer contains at least a binder resin and a colorant and has a fluidity index of from 50 to 90 and a floodability index of from 45 to 96.

18. The developing-assembly unit according to claim 17, wherein said developer has a fluidity index of from 60 to 80 and a floodability index of from 81 to 90.

19. The developing-assembly unit according to claim 17, wherein said developer further contains a release agent.

20. The developing-assembly unit according to claim 19, wherein said release agent is one of low-molecular-weight polypropylene and a modified product thereof, low-molecular-weight polyester and a modified product thereof, and an ester wax.

21. The developing-assembly unit according to claim 19, wherein said release agent is an ester wax.

22. The developing-assembly unit according to claim 17, wherein said developer is a non-magnetic one-component developer of the color yellow, magenta, cyan or black.

23. The developing-assembly unit according to claim 17, further comprising removal means, in pressure contact with the latent-image-bearing member, for removing a residual developer having remained on the latent-image-bearing member after a toner image, formed by the developing of the electrostatic latent image with said developer, has been transferred to a transfer material.

24. The developing-assembly unit according to claim 17, wherein said developing means further comprises:

a coating member configured and positioned to coat said developer onto said developing member; and a charging auxiliary member configured and positioned to assist the charging of said developer in contact with said developer whose coat weight has been controlled on said developing member.

25. The developing-assembly unit according to claim 24, wherein said charging auxiliary member has the shape of a roller.

26. The developing-assembly unit according to claim 17, wherein said at least two rotary agitation and transport means are rotated in synchronization without any mutual interference.

27. The developing-assembly unit according to claim 17, wherein said developer further contains a silica having been subjected to hydrophobic treatment.

28. The developing-assembly unit according to claim 17, wherein said developer further contains at least two types of fluidity improvers.

29. The developing-assembly unit according to claim 17, wherein, in a number-based circle-corresponding diameter/circularity scatter diagram as measured with a flow type particle image analyzer, the particles of said developer have a circle-corresponding number-average particle diameter D1 of from 2.0 $\mu$m to 10.0 $\mu$m and have an average circularity of from 0.920 to 0.995 and a circularity standard deviation of less than 0.040.

30. The developing-assembly unit according to claim 29, wherein the average circularity of the particles of said developer is from 0.950 to 0.995 and the circularity standard deviation is less than 0.035.

31. The developing-assembly unit according to claim 29, wherein the average circularity of the particles of said developer is from 0.970 to 0.995 and the circularity standard deviation is from 0.015 to 0.035.

* * * * *

UNITED STATES PATENT AND TRADEMARK OFFICE

CERTIFICATE OF CORRECTION

PATENT NO. : 6,859,633 B2 
DATED : February 22, 2005
INVENTOR(S) : Satoshi Handa et al.

It is certified that error appears in the above-identified patent and that said Letters Patent is hereby corrected as shown below:

Drawings,
Sheet 7, Fig. 10, “CHARGING-AUXILLIARY” should read -- CHARGING-AUXILIARY --.

Column 2,
Line 8, “fist” should read -- first --.
Line 30, “black,” should read -- black --.

Column 6,
Line 59, “on” should read -- in --.

Column 12,
Line 5, “a charging auxiliary” should read -- an auxiliary charging --.

Column 14,
Line 30, “Properties” should read -- Properties” --.
Line 32, “Association)”” should read -- Association) --.

Column 15,
Line 14, “procractor” should read -- protractor --.

Column 18,
Line 55, $=\left\{\sum_{i=1}^{m} (\bar{c}_{.} - ci)^2 / \sum_{i=1}^{m-1} (fci)\right\}^{1/2}$ should read -- $\left\{\sum_{i=1}^{m} (\bar{c} - ci)^2 / \sum_{i=1}^{m-1} (fci)\right\}^{1/2}$ --.

Column 19,
Line 27, “p-ethylstyrenee” should read -- p-ethylstyrene --.
Line 28, “p-n-hexystyelene” should read -- p-n-hexylstyrene --.

Column 20,
Line 14, “In” should read -- An --.

Column 23,
Line 18, “$[R_1—COO—(CH_3)_n]—C—[(CH_2)_n—OCO—R_2]_b$” should read

-- $-[R_1—COO—(CH_2)_n]_a—C—[(CH_2)_m—OCO—R_2]_b$ --.

UNITED STATES PATENT AND TRADEMARK OFFICE

CERTIFICATE OF CORRECTION

PATENT NO. : 6,859,633 B2
DATED : February 22, 2005
INVENTOR(S) : Satoshi Handa et al.

It is certified that error appears in the above-identified patent and that said Letters Patent is hereby corrected as shown below:

Column 23 (cont'd),

Line 39, "$(CH_2)_a\rfloor_b$—C" should read -- $(CH_2)_n\rfloor_a$—C --; and

"$(CH_2)_a$—OCO" should read -- $(CH_2)_m$—OCO --.

Column 27,
Line 47, "blades," should read -- blades --.
Line 48, "changed" should read -- changed, --.

Column 29,
Line 2, "was" should read -- were --.

Column 30,
Lines 22 and 42, "part" should read -- parts --.

Column 31,
Line 11, "$\mu$g" should read -- /g --.

Column 40,
Line 66, "or" should be deleted.

Column 42,
Line 21, "ratio S2/S1," should read -- ratio S2/S1 --.

Signed and Sealed this

Seventeenth Day of January, 2006

JON W. DUDAS
*Director of the United States Patent and Trademark Office*